US011300121B2

(12) United States Patent
Correa et al.

(10) Patent No.: US 11,300,121 B2
(45) Date of Patent: Apr. 12, 2022

(54) DOWNHOLE PUMP SAND FILTERING SNARES

(71) Applicant: Harbison-Fischer, Inc., Crowley, TX (US)

(72) Inventors: Felipe Correa, Fort Worth, TX (US); Sergio Granados, Mansfield, TX (US); Bradley C. Rogers, Burleson, TX (US); Riyadh Salloom, Crowley, TX (US); Oscar Zizo, Crowley, TX (US); Randy De Werff, The Woodlands, TX (US); Ramamurthy Narasimhan, Bangalore (IN)

(73) Assignee: HARBISON-FISCHER, INC., Crowley, TX (US)

( * ) Notice: Subject to any disclaimer, the term of this patent is extended or adjusted under 35 U.S.C. 154(b) by 0 days.

(21) Appl. No.: 16/802,365

(22) Filed: Feb. 26, 2020

(65) Prior Publication Data

US 2020/0263688 A1 Aug. 20, 2020

Related U.S. Application Data

(63) Continuation-in-part of application No. 16/358,096, filed on Mar. 19, 2019, now abandoned.

(Continued)

(51) Int. Cl.

*E21B 43/12* (2006.01)
*F04B 53/20* (2006.01)

(Continued)

(52) U.S. Cl.

CPC ..... *F04B 53/20* (2013.01); *E21B 43/126* (2013.01); *F04B 47/026* (2013.01); *F04B 47/12* (2013.01)

(58) Field of Classification Search

CPC ..... E21B 43/126; E21B 43/127; F04B 53/20; F04B 47/12; F04B 47/026

See application file for complete search history.

(56) References Cited

U.S. PATENT DOCUMENTS 7,686,598 B2 3/2010 Williams
8,858,187 B2 * 10/2014 Lane ..... F04B 47/02 417/53

(Continued)

OTHER PUBLICATIONS

Sucker-Rod Pumping Handbook, "Sucker-Rod Pumpting System Components and Their Operation", http://dx.doi.org/10.1016/B978-0-12-417204-3.00003-0, Elsevier Inc., 2015, pp. 57-246.

International Search Report and Written Opinion dated Jan. 13, 2021 in connection with International Application No. PCT/US2020/048571, 11 pages.

*Primary Examiner* — Giovanna Wright
*Assistant Examiner* — Yanick A Akaragwe
(74) *Attorney, Agent, or Firm* — Phillips Winchester

(57) ABSTRACT

Disclosed is a plunger for use in a sucker-rod pumping system. The plunger reciprocates within a barrel. The plunger comprises first, second, and third sections, in which the first and third sections are sealed against the barrel and in which a second section is between the first and third sections and in some embodiments may be a pull tube. A through passage for production fluid is provided, along with a pressure balancing chamber that is connected to the through passage via a sand snare, where the pressure balancing chamber is operable to equalize pressure on longitudinal sides of the seals, whereas the sand snare operates to restrain solids from reaching the pressure balancing chamber from the through passage (which is carrying the production fluid) and thereby create a slippage flow in the pressure balancing chamber, which equalizes pressure between the balancing chamber and the plunger's through passage. Further disclosed in embodiments a port between the second section and the first or third sections, where the port allows (Continued)

in one passage production fluid to pass through it between sections and in another passage or chamber allows slippage fluid to pass through it between sections.

19 Claims, 16 Drawing Sheets

Related U.S. Application Data

(60) Provisional application No. 62/892,831, filed on Aug. 28, 2019, provisional application No. 62/810,599, filed on Feb. 26, 2019, provisional application No. 62/652,364, filed on Apr. 4, 2018.

(51) Int. Cl.
*F04B 47/12* (2006.01)
*F04B 47/02* (2006.01)

(56) References Cited

U.S. PATENT DOCUMENTS

| | | | | |
|---|---|---|---|---|
| 10,060,236 | B1 | 8/2018 | Ippolito | |
| 10,132,152 | B2 | 11/2018 | Leitch | |
| 10,385,663 | B2 | 8/2019 | Lane et al. | |
| 2002/0092808 | A1* | 7/2002 | Lauritzen | E21B 43/08 210/497.01 |
| 2005/0045383 | A1* | 3/2005 | Seaton | E21B 21/065 175/66 |
| 2011/0008180 | A1* | 1/2011 | Williams | F04B 47/02 417/53 |
| 2013/0039780 | A1 | 2/2013 | Lane | |
| 2016/0258256 | A1* | 9/2016 | Nguyen | B22F 3/10 |
| 2018/0298736 | A1 | 10/2018 | Bailey et al. | |
| 2019/0112900 | A1* | 4/2019 | Osunjaye | E21B 43/086 |

* cited by examiner 679
677
675
681
SECTION B-B 679
675
A
A
681
335
SECTION C-C

335
B
C
C
B
677

675
677
335
SECTION A-A 679
677
675
681

677
679
675

DOWNHOLE PUMP SAND FILTERING SNARES

RELATED APPLICATIONS

The present application is a Continuation-In-Part of U.S. application Ser. No. 16/358,096 filed Mar. 19, 2019 which is a non-provisional claiming priority to U.S. Provisional Application No. 62/652,364 filed on Apr. 4, 2018, and is a non-provisional claiming priority to U.S. Provisional Application No. 62/810,599 filed on Feb. 26, 2019 and U.S. Provisional Application No. 62/892,831 filed on Aug. 28, 2019. All of the above applications are incorporated by reference herein for all purposes.

FIELD OF THE DISCLOSURE

The present disclosure relates, in some embodiments, to implementing sand snares for production in sandy environments, particularly including in sucker rod pumping systems.

BACKGROUND OF THE DISCLOSURE

Upon completion of drilling an oil well, fluids from the oil well may be under sufficient innate or natural pressure to allow the oil well to produce on its own. Therefore, crude oil in such wells can rise to the well surface without any assistance. But, even though an oil well can initially produce on its own, natural pressure generally declines as the well ages. In many oil wells, therefore, fluids are artificially lifted to the surface with downhole or subsurface pumps. Sucker rod pump systems are commonly used systems to transport these fluids from downhole oil-bearing zones to the well surface to be collected, refined, and used for various applications.

Typical sucker rod pump systems have a plunger that reciprocates inside a barrel while attached at the end of a string of sucker rods. A prime mover, such as a gasoline or diesel engine, or an electric motor, or a gas engine, on the surface causes a pump jack to rock back and forth, thereby moving the string of sucker rods up and down inside of the well tubing.

The string of sucker rods operates the subsurface pump. A typical pump has a plunger that is reciprocated inside of a barrel by the sucker rods. The barrel has a standing one-way valve, while the plunger has a traveling one-way valve, or in some pumps the plunger has a standing one-way valve, while the barrel has a traveling one-way valve. Reciprocation charges a compression chamber between the valves with fluid and then lifts the fluid up the tubing toward the surface.

In some wells, there is a problem with sand being pumped up in the production fluid. The sand abrades the upper parts of the plunger and may even enter between the plunger and the barrel, thereby degrading the fluid seal between the plunger and the barrel. Pump components in a sandy well require frequent replacement. Assignee has previously described and patented certain solutions to the problems described here in U.S. Pat. No. 7,686,598 the entirety of which is incorporated by reference herein for all purposes.

SUMMARY OF THE EMBODIMENTS

Disclosed are embodiments of downhole pumps that filter or snare sand to mitigate the deleterious effects of such sand on downhole pump seals and other elements. In certain embodiments, this approach comprises a downhole pump comprising a barrel having a one-way valve and a plunger within the barrel, such that the plunger and barrel reciprocate relative to each other. In this exemplary approach, the plunger has an interior passage through it and a second one-way valve, such that the plunger and the barrel form a compression chamber between the first and second one-way valves. Further, in this exemplary approach, the plunger has a first portion with a first seal with the barrel and a second portion forming a pressure-balancing chamber between the barrel and the plunger. The second portion of the plunger has an opening that allows fluid to flow between the plunger interior passage and a pressure balancing chamber. The exemplary plunger further has a third portion, with the plunger second portion being between the first and third portions, and the plunger third portion having a second seal with the barrel.

In an embodiment, within the plunger is a sand snare that allows pressure equalization between the balancing chamber and the production flow passage through the plunger, with the sand snare eliminating or reducing the passage of sand into the pressure balancing chamber.

DETAILED DESCRIPTION

Figure 1:
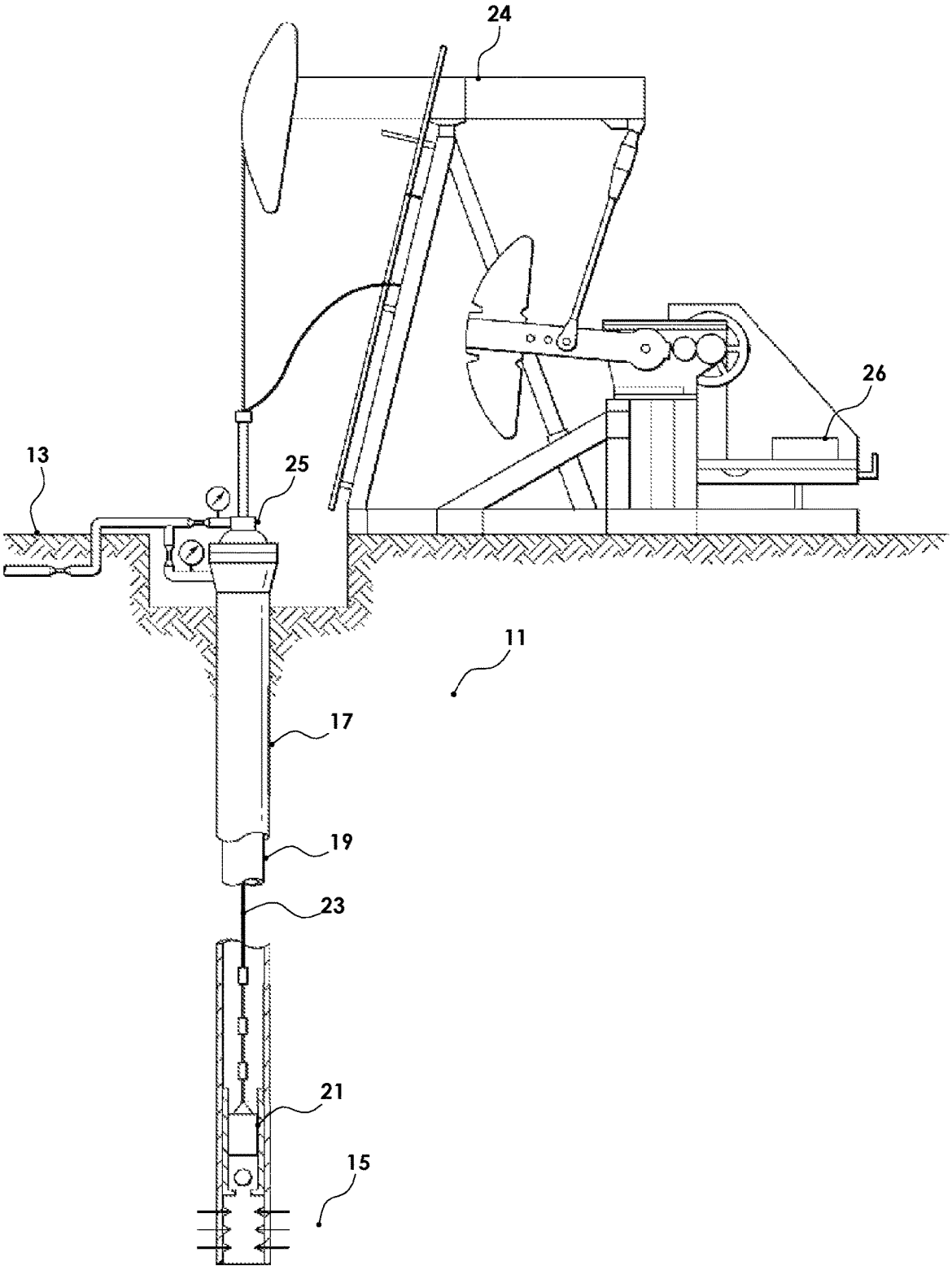
FIG. 1 shows an overall, environmental view of a sucker rod pumping well installation.

FIG. 1 illustrates a general sucker rod pumping system for a producing oil well 11. The well has a borehole that extends from the surface 13 into the earth, past an oil-bearing formation 15. The borehole has a casing 17, which is perforated at the formation 15. Tubing 19 extends inside of the casing from the formation to the surface 13.

A subsurface pump 21 is located in the tubing 19 at or near the formation 15. A string 23 of sucker rods extends from the pump 21 up inside of the tubing 19 to a polished rod and a stuffing box 25 on the surface 13. The sucker rod string 23 is connected to a pump jack unit, or beam pump unit 24, which reciprocates up and down due to a prime mover 26, such as an electric motor or gasoline or diesel engine, or gas engine.

Figure 2A:
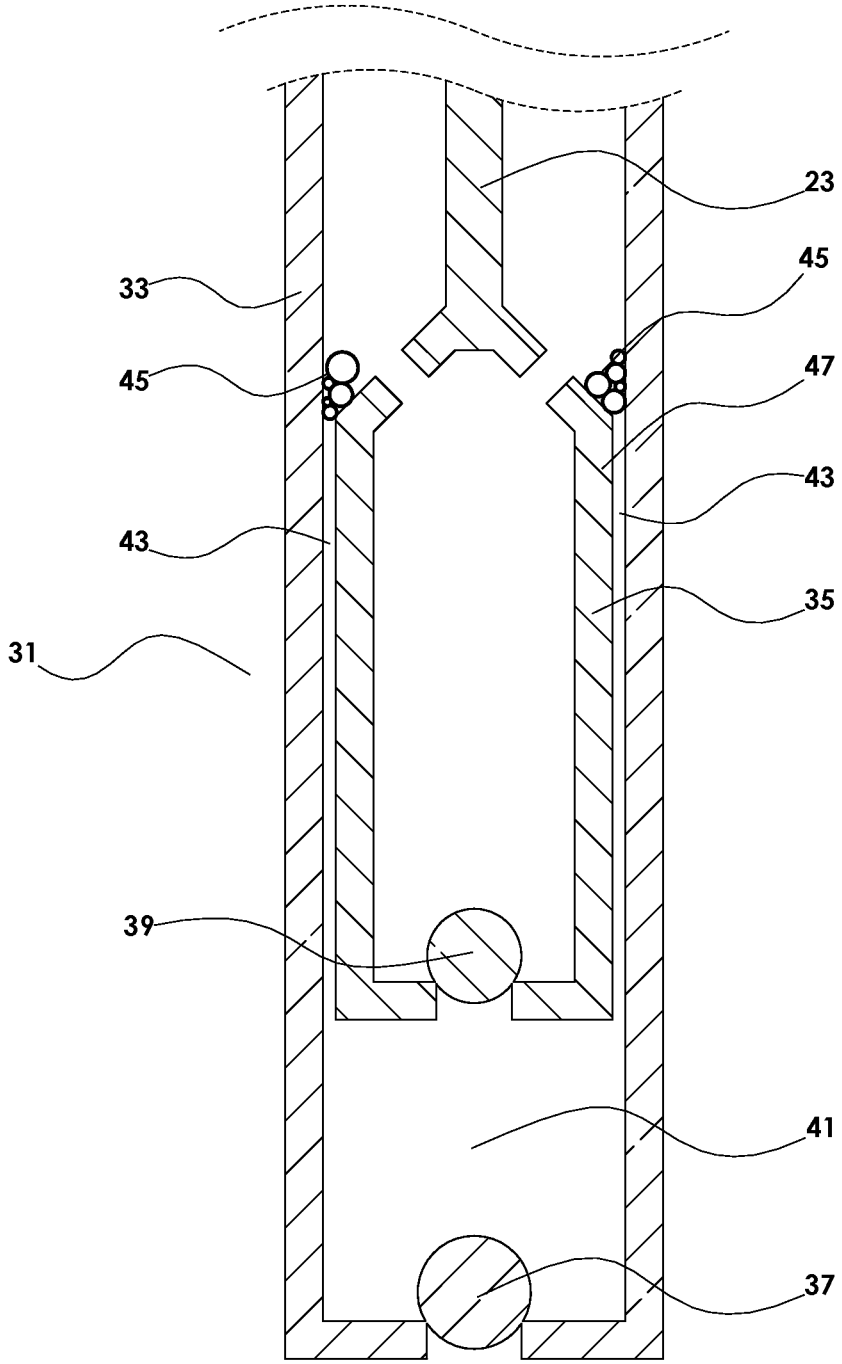
PRIOR ART FIG. 2A
FIG. 2A shows a prior art view of a sucker rod pump, including where sand can gather in such a pump when used in a sandy environment.

FIG. 2A illustrates a prior art pump 31. The pump has a barrel 33 and a plunger 35. The plunger 35 reciprocates with respect to the barrel 33. The barrel has a standing valve 37 and the plunger has a traveling valve 39. In the illustrations, the valve cage and other details are not shown.

The plunger 35 is reciprocated by the sucker rods 23. As the plunger 35 is raised on the upstroke, the traveling valve 39 is closed and the standing valve 37 is opened, wherein fluid is drawn into the compression chamber 41 between the two valves 37, 39. Thus, on the upstroke, the compression chamber 41 is charged with fluid. The fluid above the traveling valve 39 is lifted toward the surface. As the plunger 35 descends on the downstroke, the traveling valve 39 opens and the standing valve 37 closes, thereby forcing the fluid in the compression chamber 41 into the plunger.

The outside diameter of the plunger 35 is sized to provide a fluid seal 43 between the plunger and the barrel. The fluid seal is formed by the fluid entering a clearance between the plunger 35 and the barrel 33. In embodiments, the clearance between the plunger and barrel may be between 0.002 and 0.008 inches, in other embodiments, this clearance may be between 0.008 and 0.02 inches, and in certain other embodiments the clearance may be between 0.020 and 0.030 inches to form this fluid seal 43.

If the fluid contains sand 45, the plunger 35 exhibits wear. This is because on the upstroke, the plunger 35 moves up into the sand 45 that is just above the plunger. The top end 47 of the plunger 35 exhibits the most wear from the sand due to the upstroke motion and due to fluid pressure. The column of fluid in the tubing extending to the surface exerts pressure on the top end of the plunger. This fluid pressure tends to force fluid with sand between the plunger 35 and the barrel 33, independently of the movement of the plunger.

Figure 2B:
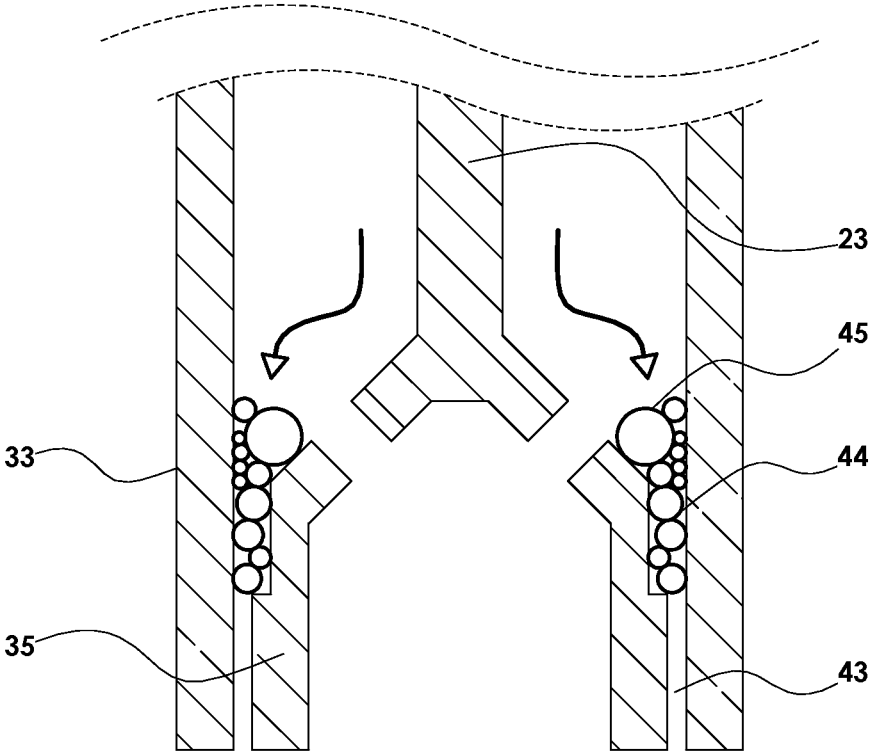
PRIOR ART FIG. 2B
FIG. 2B shows an additional prior art view providing more contextual background on the difficulties with prior art sucker rod pumps used in sandy environments.

FIG. 2B provides additional detail of the prior art systems as subjected to a sandy environment. Fluid encountered in downhole pump systems by the wellbore generally contains sand in varying amounts and sand grain sizes according to the well conditions. Sand or solid materials contained or suspended within wellbore fluids can degrade downhole pump components through mechanisms including friction-caused abrasion from sandy production fluid contacting system components throughout the pumping cycle. An example of this damaging condition is shown in FIG. 2B. As shown in FIG. 2B, during the upstroke part of the pumping cycle, as valve rod 23 pulls plunger 35 upwards, sand 45 from the production fluid initially collects in spaces 44 found in the space 44 between the barrel 33 and the top portion of the plunger. Eventually, sand reaches additional spaces 43 between the barrel 33 and plunger 35. As the plunger 35 moves, sand 45 causes wear on the plunger 35, barrel 33, and other system components. Movement-based wear caused by sand eventually degrades downhole pump system components. The sand-based wear causes pitting in the originally substantially smooth components of the downhole pump system, degrading the seal between the plunger and the barrel, leading to excessive fluid leakage and dropping the overall volumetric efficiency of the pump.

In addition to sand 45 causing wear during pumping cycles, it can also greatly impair or even completely prevent valve rod 23 motion, especially when a resting downhole pump system is reactivated. For example, if the downhole pump system is shut down for any reason, sand may significantly deposit on the upper portion of the plunger 35, which can create enough friction to fully prevent or drastically impede valve rod 23 movement, requiring significant maintenance to repair the system.

Figure 3:
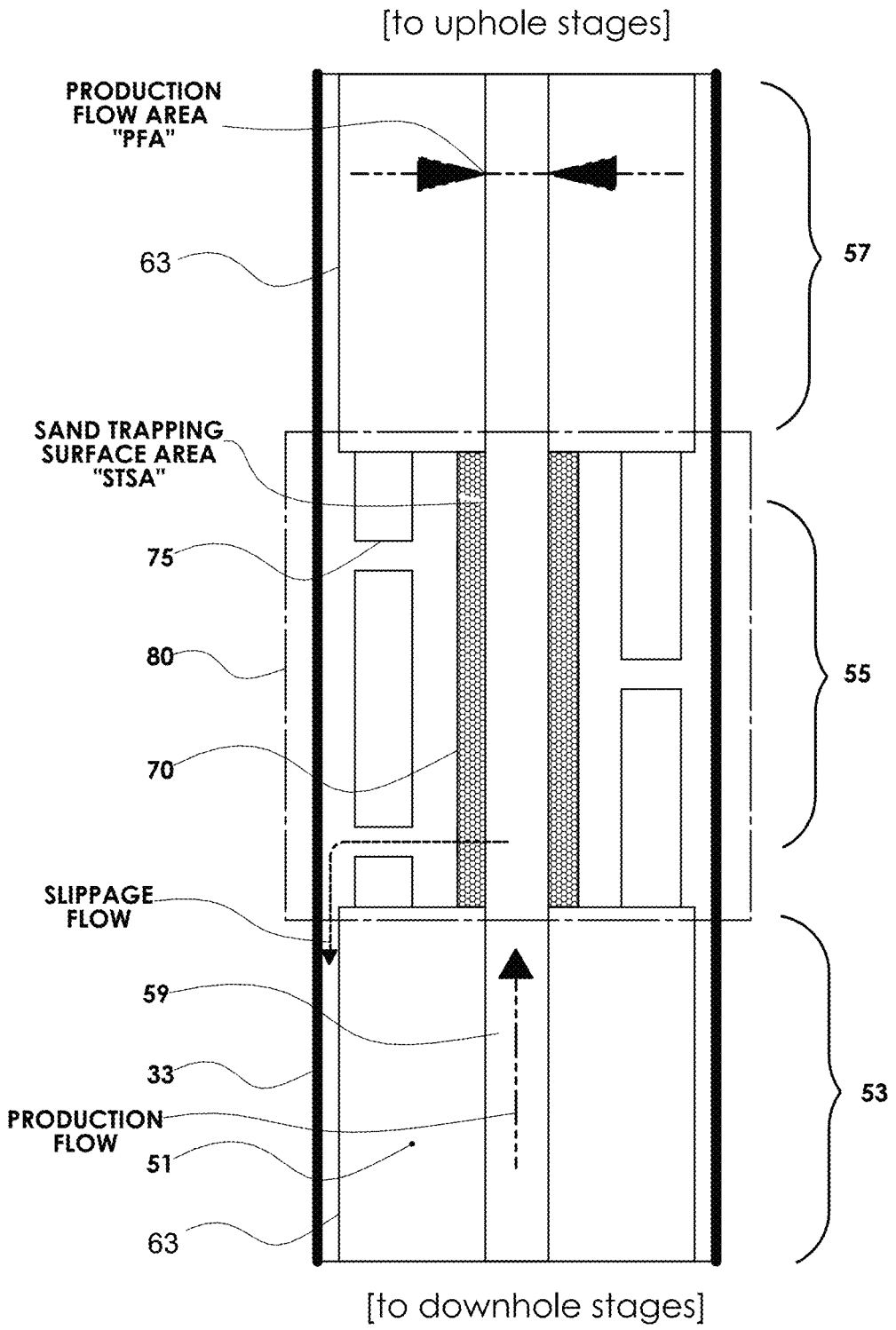
FIG. 3 illustrates an embodiment in accordance with the present disclosure in which a pressure balancing chamber approach is used with a sand snare in order to provide a clean slippage flow for pump lubrication while passing the sandy production flow to the wellhead.

FIG. 3 illustrates an embodiment approach in which a portion of a barrel 33 and plunger 51 assembly intersect and in which a production flow 59 is pumped up-hole for collection and production. The generally cylindrical plunger 51 has several parts or portions. The plunger 51 has a first portion 53, a second portion 55 and a third portion 57. Thus, the plunger first portion 53 is below (downhole from) the second and third portions 55, 57. The plunger second portion 55 is between the plunger first and third portions 53, 57. The plunger may be a single component or an assembly of several parts functioning synergistically to produce well fluids, in this document the segregation by parts or portions is done based on function, not necessarily the on physical embodiment. The form, fit, and function of the first, second, and third plunger portions may be physically accomplished with a single part, or with multiple parts. The plunger second portion is also sometimes referred to as a pull tube in the present document as well as generally when referring to an intermediate section joining upper and lower sealing sections of a plunger. The pump 21 may be used in a non-vertical orientation, and may even be used in a horizontal orientation.

The plunger third portion 57 is equipped with seals 63 around the circumference. The seals 63 form a seal against the barrel 33 inside diameter. In an embodiment, the seals may be valve cups, although other types of seals can be used. For example, the seals can be of elastomeric material and have a fiber component. Or the seals 63 may be fluid seals in accordance with design needs. Sand would serve to abrade and wear the seals 63 during pumping operations, and so the present embodiments serve to reduce the wear on seals 63 by using a pressure balancing chamber 43 that serves to balance the fluid pressures on either side of the seals, and further a slippage flow 70 is provided as a flow of clean (sand-free) fluid to lubricate and help preserve the seals 63 of the pump 21. A number of ways of implementing these pressure balancing chambers and slippage flow are provided in further figures and description below (see FIG. 4 et seq. and accompanying text).

To keep the slippage flow clean and sand-free, one of a number of types of sand snares 70 may be used in the presently described embodiments as a barrier or other diverter relative to the production flow that is to be diverted for usage as slippage flow.

In disclosed embodiments, the plunger portions 53, 55, 57 may be joined together with couplings (not shown here). Further in disclosed embodiments, the coupling may be integrated with ports ("bleeding ports") 75 that provide for the passage of slippage flow around the couplings and/or seals to allow the slippage flow 59 to continue downhole to lubricate the reciprocating elements and to provide for pressure balancing in the pressure balancing chamber 43. The second portion 55 may serve as its own coupling and as a separate physical element from the first and section portions 53, 57. In this embodiment, we can refer to the second portion as a balancing chamber coupling or subsection 80, and this approach will be further described with respect to FIG. 9 et seq.

The pressure balancing chamber 43 of this embodiment comprises a distributed pressure balancing chamber, which minimizes potential pressure differentials. In a disclosed embodiment, the sand trap has a distributed surface area of at least a plurality of openings or ports between the interior of the plunger 59 containing the production flow to the pressure balancing chamber 43. In an embodiment, the effective surface area of the sand trap (the "Sand Trap Surface Area" or "STSA") is at least 2.5 times the area of the production flow area (or "PFA"). With a circular inner diameter of the plunger 51 of diameter "d", formulaically this can be represented as the formula:

$$STSA \geq 2.5 * \pi * d$$

In other embodiments, the ratio of the STSA to the PFA may be greater than or equal to one ($STSA \geq \pi * d$) or greater than or equal to 1.5 or 2.0. The specific ratio chosen will be according to design needs, but specifically the presently disclosed embodiments provide the ability to design these higher ratios while providing for a balancing pressure chamber to avoid pressure imbalances across the seals 63.

Following are figures and description providing specific exemplary embodiments in which the approach of FIG. 3 can be specifically implemented. The following embodiments have unique advantages that can be synergistically combined and or applied by a person of ordinary skill in the art according to design needs.

Figure 4A:
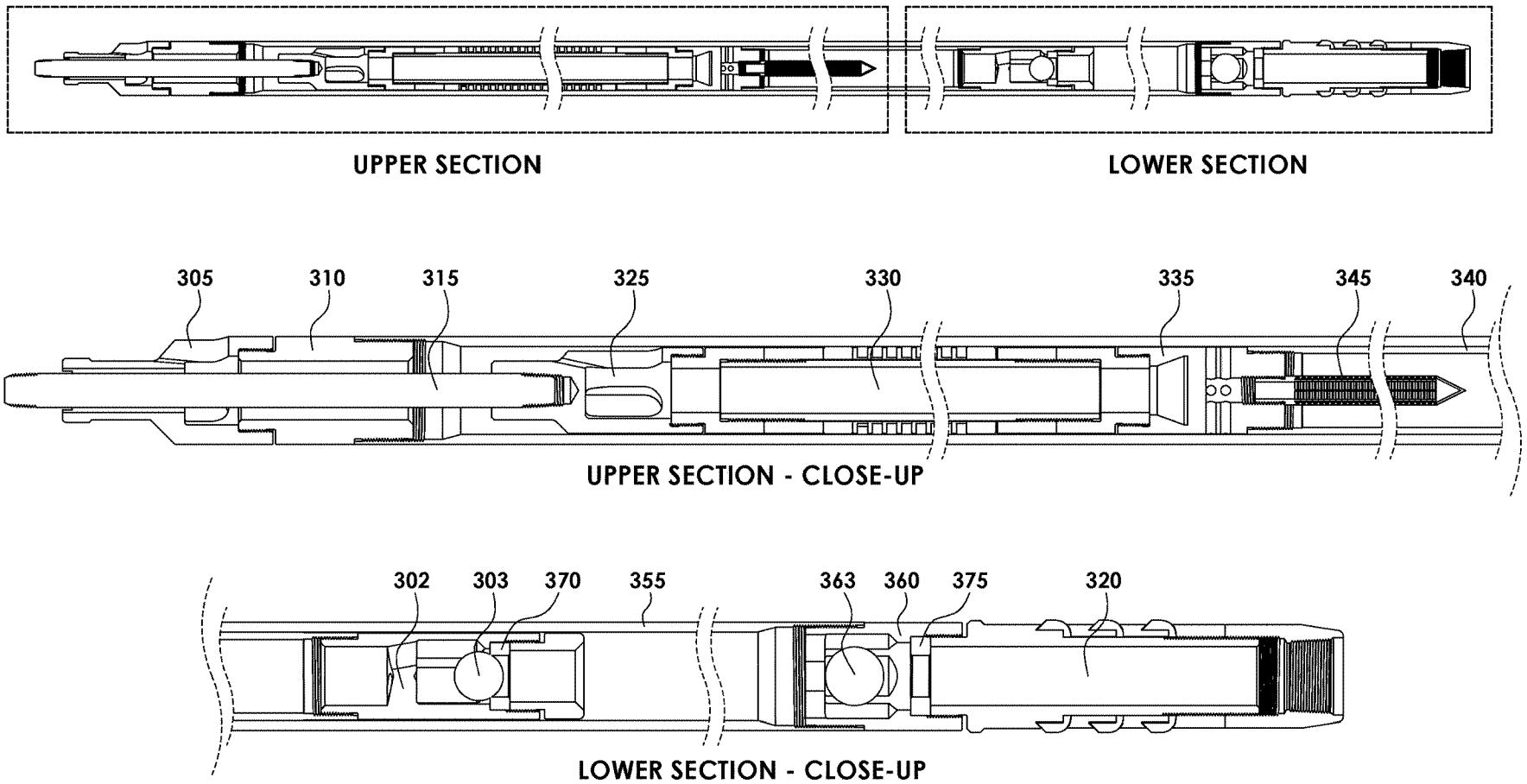
FIG. 4A illustrates a longitudinal cross-sectional view of a sucker-rod pumping system during an upstroke part of the pumping cycle, according to a specific example embodiment of the disclosure.

Ported Coupling Embodiments:

FIG. 4A illustrates a cross-sectional view of an sucker-rod pumping system during an upstroke stage as disclosed in this application. During the upstroke, the section marked in red in the figure is a high-pressure (hydrostatic pressure due to the fluid column inside the tubing 19) section of the sucker-rod pumping system, with the section marked in green indicating a low-pressure (flowing bottom-hole pressure) section of the sucker-rod pumping system. Disclosed sucker-rod pumping systems pump or transfer fluids from the low-pressure section of the sucker-rod pumping system to the high-pressure section of the sucker-rod pumping system, which then transports the fluid to a surface facility and/or collection tank. Described sucker-rod pumping systems thereby pump production fluid from low-pressure sections into high-pressure sections of the sucker-rod pumping system. As shown in FIG. 4A, the sucker-rod pumping system includes a guide 305, a connector 310, a valve rod 315, and a hold-down 320. Disclosed guides 305 help prevent valve rod 315 misalignment based on mechanical friction that would be caused by their bending. Guides 305 can be made of metal or polymers. As shown in FIG. 4A, sucker-rod pumping systems contain top bushings 325 which connect the plunger to the valve rod, and function as the outlet port for the plunger, driving the production fluid flowing upward inside the plunger into the annular space formed by the valve rod and the barrel. Sucker-rod pumping systems also contain wiper plungers 330 that keep sand away from the box-end plunger 340, ported couplings 335 that connect two plungers, a box-end plunger 340 that lift fluid contained in the sucker rod string, sand snares 345 that separate particulate matter such as sand from fluid, traveling valves 302 that serve as a gate for fluid movement, barrels 355 that house the sucker rod string components, and stationary or standing valves 360 that serve as a gate for fluid movement. Disclosed top bushings 325 connect to wiper plungers 330, which connect to box-end plungers 340 through the ported couplings 335. Also, disclosed top bushings 325 connect to box-end plungers 340, which connect to wiper plungers 330 through the ported couplings 335.

Barrier elements or sand snares 345 described in this application connect to the ported couplings 335. As further described below with respect to disclosed embodiments, the sand snares 345 and the ported couplings 335 act to mitigate or reduce damage from sand-containing production fluid. Disclosed barrels 355 can connect to standing valves 360 and traveling valves 302. Disclosed wiper plungers 330 may be longer than, shorter than, or the same length as box-end plungers 340, furthermore, disclosed wiper plungers may be metal plungers or soft-packed plungers. Described sand snares 345 can be the same length, longer than, or shorter than box-end plungers 340 and wiper plungers 330.

Ported coupling 335 described in this application can balance the pressure between wiper plungers 330 and box-end plungers 340. Having wiper plungers 330 on top of box-end plungers 340 can keep sand particles away from a leading edge of the box-end plunger 340. Also, having box-end plungers 340 on top of wiper plungers 330 can keep sand particles away from a leading edge of the wiper plungers 330.

As described above, sand erodes or deteriorates seals between barrels 355 and wiper plungers 330. For example, sand contacts and then erodes or deteriorates parts of the wiper plunger 330 including leading edges or rings. Sand can erode seals between barrels 355 and box-end plungers 340. Eroding or deteriorating the seal lowers the efficiency of the sucker-rod pumping system, which results in costly component replacements and production losses. Prolonging the efficiency and lifetime of the sucker-rod pumping system desirably provides for better sucker-rod pumping system performance. Disclosed wiper plungers 330 are configured to wipe away or remove sand from a portion of the sucker-rod pumping system.

Disclosed wiper plungers 330 include composition rings 365 that generally swell in the presence of fluids (e.g., oil) containing hydrocarbons. Composition rings 365 may comprise of natural fibers such as cotton, or synthetic elastomers. Elastomers described in this application include natural rubbers and nitriles. Described natural fiber or elastomer compositions can vary depending on the composition of downhole fluids. Described composition rings 365 desirably serve as a barrier that prevents sand from reaching lower parts of sucker-rod pumping systems. For example, composition rings 365 of wiper plungers 330 prevent sand from passing in between the barrel 355 and the wiper plungers 330 so that the sand does not reach other components of the sucker-rod pumping system. Wiper plungers 330 include soft-packed plungers and metal plungers. Described wiper plungers 330 can have any number of composition rings 365. For example, wiper plungers 330 can have from about one composition ring 365 to about 60 composition rings 365.

As shown in FIG. 4A, disclosed ported couplings 335 transport production fluids from one plunger to another plunger, and function synergistically to reduce sand-created wear on components by improving the lubrication of the fluid-seal in sucker-rod pumping system. For example, the sand separated from the slippage flow by the box-end plunger 340 temporarily remains on the walls of the filter for about half of a stroke, to be wiped away by the production flow in the next pump stroke. The described ported couplings 335 receive filtered and substantially sand-free fluids from plungers having sand snares 345. Once received, ported couplings 335 divert sand-free fluids to function as a lubricant for downhole pump system components. Lubrication accordingly is provided when substantially sand-free slippage flow is diverted by the ported coupling 335 into the gap between a barrel and the plunger, keeping plunger and barrel components lubricated, thereby reducing wear and prolonging part life. The interior of a barrel 355 contains a wiper plunger 330 or a box-end plunger 340. Described fluid or slippage flow lubricates the box-end plunger 340, the wiper plunger 330, or both. In disclosed embodiments, slippage flow is targeted to be about 5% of the fluid derived from a downhole well or a production flow, although this percentage could be more or less in accordance with production designs in accordance with the presently disclosed embodiments. For example, in an embodiment where greater lubrication is desired, the percentage of slippage flow might be about 10%. In an embodiment where less lubrication is needed, to maximize production flow, this figure might be about 2%. The configuration of the plunger 340 and ported couplings 335 can be designed to adapt the amount of slippage flow relative to the production flow. For example, the fit and length of the plunger 340 can be adjusted to control the amount of slippage flow.

Disclosed barrels 355 include long increments of metal tubes that are generally honed, machined, and have a polished inside surface. Disclosed polished inside surface of the barrels 355 provide for substantially smooth movement of wiper plungers 330 and box-end plungers 340 within the barrels 355. Barrels 355 described in this application include pin-end barrels and box-end barrels. Described barrels 355 can have wall thickness according to designs for the well environment. For example, barrels 355 can have a heavy wall of about 3/16 inch, a thin wall of about 1/8 inch, or any thickness in between. Barrels 355 described in this application can be any length in accordance with well design. For example, disclosed barrels 355 can be made at a length of about 24 feet and connected in a serial fashion to make longer pumps. Described barrels 355 are in accordance with design requirements enough to contain plungers 330, 340, valves 302, 360, and the length of a maximum valve rod 315 stroke. Disclosed barrels 355 can be plated on the inside or outside surfaces to increase resistance to chemical or physical degradation. For example, described barrels 355 can be chrome plated, providing a harder surface to mitigate abrasion from sand. Barrels 355 described in this application can include a carbon steel base metal with nickel plating to prevent corrosion from brine, $CO_2$, $H_2S$, and chlorides.

Disclosed plungers 330, 340 include wiper plungers 330, box-end plungers 340, and pin-end plungers. Plungers 330, 340 as disclosed in this application can contain barrier elements 345 within the plungers 330, 340. Including barrier elements 345 inside the plungers 330, 340 permits the use of substantially all of the volume contained within the inside diameter of a plunger 330, 340 that encases system components. Usage of substantially all of the volume contained within the inside diameter of the plunger 330, 340 advantageously permits usage of a higher flow areas and higher mechanical strength through increased cross-sections of metal parts. Box-end plungers 340 disclosed in this application can have a smaller wall thickness and provide for less resistance to flow than pin-end plungers. Plungers 330, 340 as described in this application can be made of steel, chrome-plated steel, and nickel-plated steel. For example, plungers 330, 340 can be coated with a hard-nickel layer applied to the outer diameter by a flame-spray process and electroplating. Nickel-plated steel provides for resistance to corrosion from $CO_2$, $H_2S$, and chlorides. Chrome-plating provides for resistance to abrasive fluids. Described steel plungers can be used when fluids do not contain abrasive materials or corrosive chemicals. Various plunger lengths can be used. For example, a plunger 330, 340 length of about three feet can be sufficient for pumping oil from a depth of less than about 3,000 feet. For pumping oil from a well at a depth from about 3,000 feet to about 6,000 feet, a three feet plunger including 1 additional foot per 1,000 feet of oil well depth can be used. Additionally, plungers 330, 340 of about 6 feet in length can be used for oil wells deeper than 6,000 feet. Additionally, plungers 330, 340 of any length can be used at any depth as needed. Plungers 330, 340 can have an outside diameter ranging from about 1 inch to about 5 inches, or greater than about 5 inches.

Disclosed pump valves include a traveling valve 302 and a standing valve 360 that generally operate on a ball-and-seat principle as disclosed in FIG. 4A. Disclosed seats are generally machined, finished to prevent corrosion and erosion, ground and lapped to precisely fit a ball 303, 363 providing a positive seal. Seats 370, 375 as described in this application are generally made from metals, polymers, and ceramics. Disclosed seats 370, 375 can be made to be any size. Described balls 303, 363 can be made of any material and can be of any size. For example, balls 303, 363 as described in this application can be made from metals, polymers, and ceramics. Disclosed metals include stainless steel and alloys; polymers include polycarbonate, polyethylene, and polypropylene; and ceramics include tungsten carbide and zirconia. Generally, the balls 303, 363 and the seats 370, 375 are fitted to provide for a substantially liquid-proof seal when in a closed position. The traveling valve 302 and a standing valve 360 can be positioned both above and below a plunger 330, 340 in different pump configurations. Described valves 302, 360 can be positioned at the top of a plunger in oil wells that produce little to substantially no gas, but positioning valves 302, 360 can reduce dead space between the traveling valve 302 and the standing valve 360 and can be advantageous to oil wells that do produce gas.

Figure 4B:
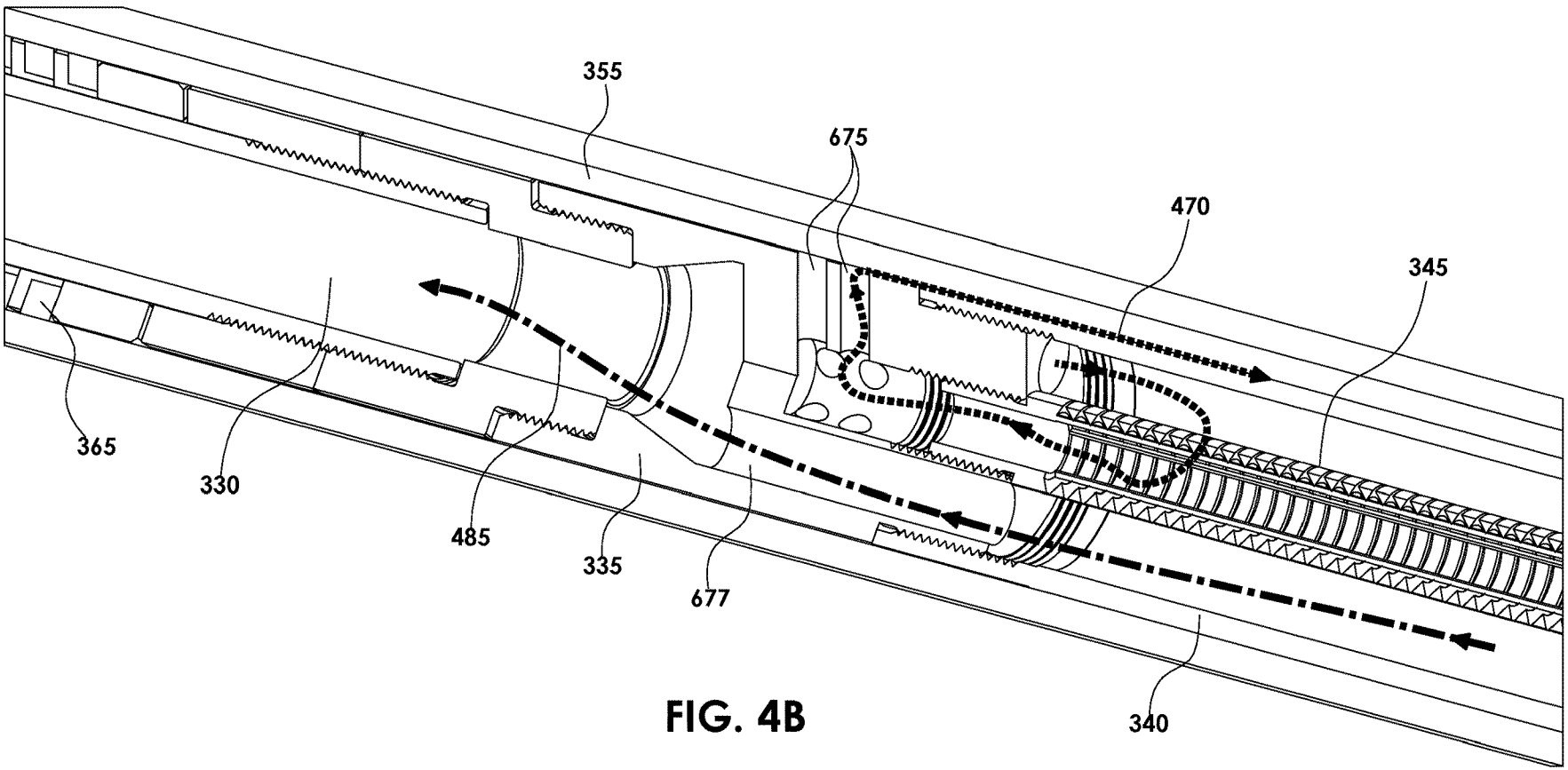
FIG. 4B illustrates a cross-sectional view of a coupling portion of the sucker-rod pump of FIG. 4A, displaying a sucker-rod pumping system displaying slippage flow and a production flow from plunger to plunger through a ported coupling, according to a specific example embodiment of the disclosure.

As shown in FIG. 4A, and as further shown and described in FIG. 4B and its accompanying text, barrier elements 345 described in this application contained within box-end plungers 340 or wiper plungers 330 can be configured to handle both production and slippage flows. Described production flow is outside of the sand snare 345 and includes fluid flowing through an annular area defined by an inside diameter (ID) of the plunger and an outside or outer diameter (OD) of the filter itself. In contrast, disclosed slippage flow includes fluid flowing into the sand snare 345. Sand filtration action, as described in this application, occurs as the slippage flow detaches or is separated from the production fluid and then flows across the sand snare 345 walls toward the inside of the sand snare 345. This filtration results in a nearly sand particle-free flow that is vented out of the plunger assembly through a ported coupling 335 as described in this application.

As illustrated in FIG. 4A and with further detail as disclosed in FIG. 4B and its accompanying text, sand snares 345 are generally constructed with profile-wire forming a tube welded to multiple support bars. Profile-wire tubes described in this application include narrow openings facing the outer diameter of the sand snare 345. Such configuration specifies an optimal direction of filtration, which can directly impact the ability of sand snares 345 to prevent premature obstruction of the openings due to material accumulation. On each downstroke of the pump, the production flow traveling alongside the sand snare 345 between the outer diameter of the barrier and the inner diameter of the plungers 330, 340, at a substantially high speed, and inducing turbulence as it flows upwards relative the sand snare 345, will wipe away the excess material that may have accumulated on the outer diameter of the sand snare 345 during the previous upstroke of the pump. This specific orientation of the profile wire also designates the sand snare 345 as an "outside-to-inside" sand snare 345 or filter. The sand snare 345 implemented, according to embodiments described in this application, is meant to work with dirty fluid outside and clean fluid inside, the dirty fluid being the crude production flow received from the wellbore, and the clean fluid being the filtered slippage flow. Additionally, support bars described in this application include narrow openings facing away from the outer diameter of the sand snare 345. This could designate an "inside-to-outside" sand snare 345 or filter. The ported coupling supports the sand snare 345 and may hold it centered along the axis of the plungers 330, 340, maximizing the effective filtration area of the sand snare 345.

Disclosed sand snare 345 can be referred to as a strainer. Described sand snare 345 design includes varying slot widths, constructive materials, wire calibers, orientation, length, outer diameter, and inner diameter based on the needs of a specific application. For example, disclosed sand snares 345 include slot widths from about 0.001 inches to about 0.010 inches, or even greater than 0.010 inches.

Sand snares 345 described in this application include various other types of filters as long as they provide a barrier for sand while allowing the flow of fluids with minimal pressure drop. Described sand snares 345 can be manufactured by chemical etching, laser cutting, electro-discharge machining, water jetting, electroforming, plasma cutting, photolithography methods, or 3D-printing may as well be implemented in the present disclosure, in a similar manner as specified above. Sand snares 345 disclosed in this application can be made of metal and of polymers. Sand snares 345 length and outer diameter are only restricted by the dimensions of the plunger into which they are installed. Typical plunger lengths range from three to six feet for most American Petroleum Institute (API) pump configurations, and typical inner diameter of box-end plungers range from 0.88" to 4.00" depending on the pump size. Additionally, sand snares 345 are sized to allow for an annular region inside the plunger for the production of fluids, and for that purpose the outer diameter of the sand snare is typically 0.50" smaller than the inner diameter of the plunger.

Hold-downs 320, as disclosed in this application generally affix or set a stationary part of a sucker-rod pumping system to a tubing string. Hold-downs 320 include a seating ring that forms a metal-to-metal seal on the inside of a seating nipple previously installed in the wellbore. For example, disclosed hold-downs 320 can affix plungers 330, 340 or a barrel 355 to the tubing string. Hold-downs 320 include cup-type or mechanical hold-downs. Mechanical hold-downs as disclosed in this application can be used in well bores above 250° F. and positively lock onto the seating nipple recess by a spring action. Disclosed cup-type hold-downs use mechanical friction to seal onto the seating nipple.

FIG. 4B illustrates a cross-sectional view of a coupling portion 335 of a sucker-rod pump according to a specific example embodiment of the disclosure. FIG. 4B depicts components of disclosed sucker-rod pumping systems that synergistically reduce sand-induced wear and lubricate components to extend component life and enhance produced fluid quality. As shown in FIG. 4B, wiper plungers 330 connect to box-end plungers 340 through a ported coupling 335. Described slippage flow 470 traveling through sand snares 345 embedded in box-end plungers 340 flows in the direction from outside-to-inside. Additionally, fluid traveling through sand snares 345 can flow in the direction from inside-to-outside the box-end plunger via the ported coupling 335. As shown in FIG. 4B, the production flow 485 travels on the outside of the filter or sand snare 345, and the slippage flow 470 travels on the inside of the sand snare 345 or pass through it. Substantially sand-free slippage flow 470 is directed outward to the radial ports 675 (See FIG. 6A-6F) to lubricate components of box-end plunger 340 and barrel 355. The filter or sand snare 345 is connected to the ported coupling 335 between the wiper plunger 330 and the box-end plunger 340. The ported coupling 335 simultaneously or sequentially permits passage of the production flow 485 and passage of the slippage flow 470 without communication or contact between the production flow 485 and the slippage flow 470 after the slippage flow 470 has passed through the filter or sand snare 345. The disclosed ported coupling 335 structure that effects this separation is further described in FIGS. 6A-6F below.

Wiper plungers 330 and box-end plungers 340 disclosed in this application have sand snares 345. Having sand snares 345 inside of the plungers increase both structural integrity and strength of sucker-rod pumping systems in comparison to corresponding sucker-rod pumping systems without sand snares 345. If the sand snares 345 are contained within plungers, the sand snares 345 themselves do not have to directly withstand hydrostatic pumping pressures, weight from sucker-rod pumping system components. Also, in disclosed embodiments where sand snares 345 are not contained within a plunger, a reduced sand snare 345 volume may be used to maintain structural integrity, which restricts fluid flow rates.

Disclosed strings of sucker rods have individual sucker rods that are connected to each other in series. Described strings of sucker rods can be continuous or segmented, of uniform cross section or tapered, and the sucker rods can be made of steel and polymer composites.

Figure 5:
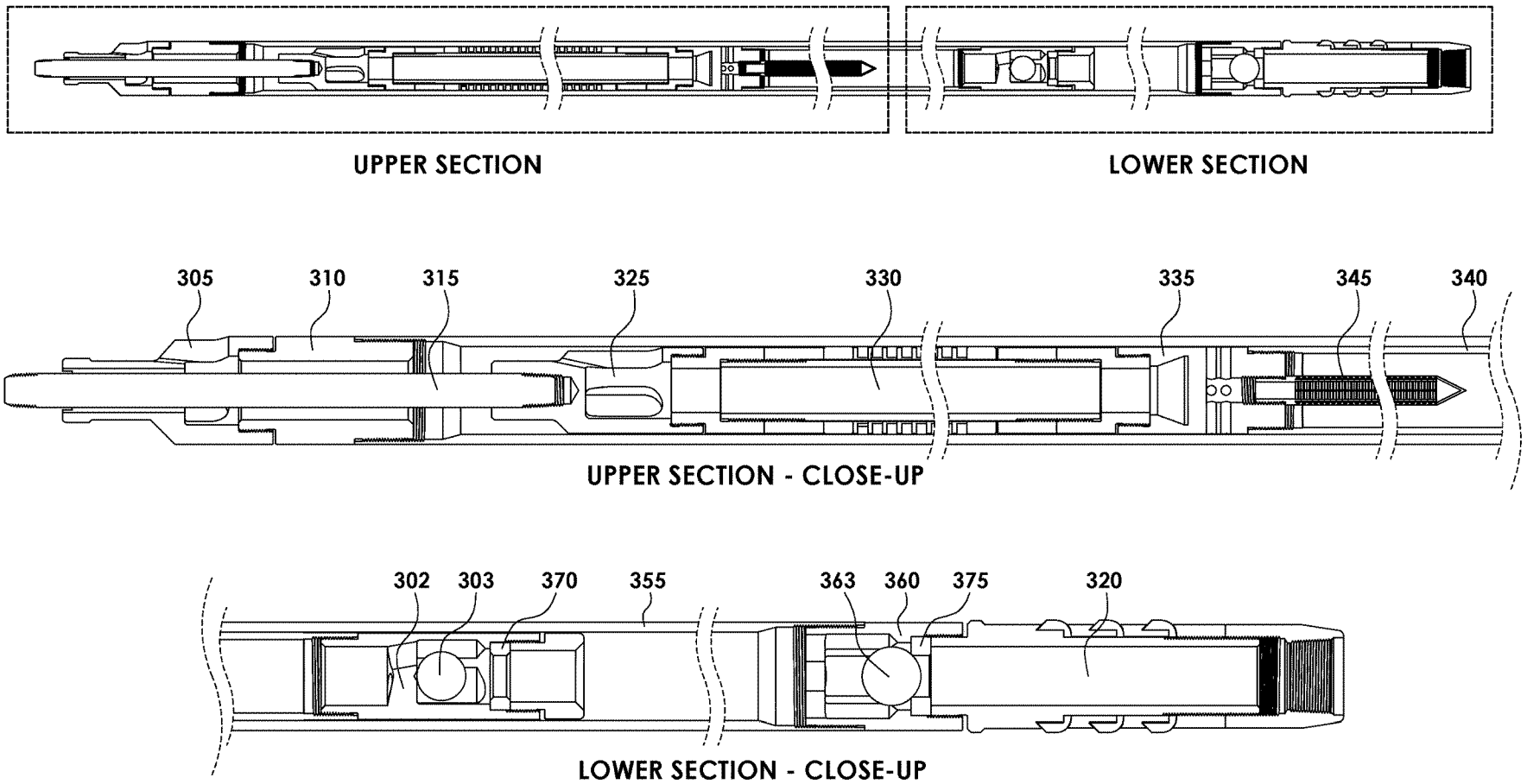
FIG. 5 illustrates a cross-sectional view of a sucker-rod pump during an upstroke part of the pumping cycle and having a wiper plunger, a box-end plunger, and a sand snare or barrier element according to a specific example embodiment of the disclosure.

FIG. 5 illustrates a cross-sectional view of an embodiment sucker-rod pump comprising a sand snare 345. As shown in the figure, a top bushing 325 connects to a wiper plunger 330, and the wiper plunger 330 connects to a box-end plunger 340 through a ported coupling 335. Additionally, the top bushing 325 can connect to box-end plunger 340, which can then connect to wiper plunger 330 through ported coupling 335. As further shown, a box-end plunger 340 connects to a traveling valve 302. Additionally, box-end plunger 340 or wiper plunger 330 can connect to traveling valve 302. In FIG. 5, dashed arrows provide the direction of flow for a slippage fluid 470, so that the slippage fluid can flow through the sand snare 345 and to a space in between the box-end plunger 340 and the barrel 355. When the traveling valve 302 is open, the standing valve 360 is closed. When the standing valve 360 is open, the traveling valve 302 is closed. Described standing valves 360 and the traveling valves 302 can open or close due to fluid pressure during an upstroke or down stroke; assisted by the gravity.

FIGS. 6A-6F provide a series of views of an exemplary ported coupling in accordance with disclosed embodiments. Disclosed ported couplings 335 generally connect two plungers that can be the same or different. For example, disclosed ported couplings 335 can connect a wiper plunger 330 to a box-end plunger 340, a box-end plunger 340 to a box-end plunger 340 and a wiper plunger 330 to a wiper plunger 330. Described ported couplings 335 generally have a cylindrical shape and can have a length from about 1 inch to about 12 inches and can have a diameter from about 1 to about 5 inches. Additionally, ported couplings 335 can have a length of greater than about 12 inches and an outer diameter of greater than about 5 inches. Ported couplings 335 can have a length of about 10 inches and a diameter of about 2 inches, or a length of about 8 inches and a diameter of about 3 inches, or a length of about 6 inches and a diameter of about 1 inch, or a length of about 12 inches and a diameter of about 5 inches.

Ported couplings 335 have longitudinal ports 677, which permit production flow 485 (See FIGS. 4-5) to travel from a plunger containing a sand snare 345 through the ported coupling 335 and to another plunger. The ported coupling 335 can have any number of longitudinal ports 677. For example, disclosed ported coupling 335 can have 1-10 longitudinal ports 677, or greater than 10 longitudinal ports 677. For example, ported couplings 335 can have 2 longitudinal ports 677, or 4 longitudinal ports 677, or 6 longitudinal ports 677, or 8 longitudinal ports, or 10 longitudinal ports 677, or 12 longitudinal ports 677. Described longitudinal ports 677 can have any diameter. For example, longitudinal ports 677 can have a diameter from about 0.25 to about 1 inch, as space allows for the different pump sizes. A longitudinal port can have a diameter of about 0.25 inches, or of about 0.5 inches, or of about 0.75 inches, or of about 1 inch. Longitudinal ports 677 described in this application can have a diameter of greater than about 1 inch. Disclosed longitudinal ports 677 can have a length from about 0.5 to about 24 inches, or even greater than about 24 inches. Described longitudinal ports 677 can have a length of about 0.5 inches, or of about 1 inch, or of about 4 inches, or of about 8 inches, or of about 12 inches, or of about 16 inches, or of about 20 inches, or of about 24 inches.

Figures 6A, 6B, 6C, 6D, 6E, 6F:
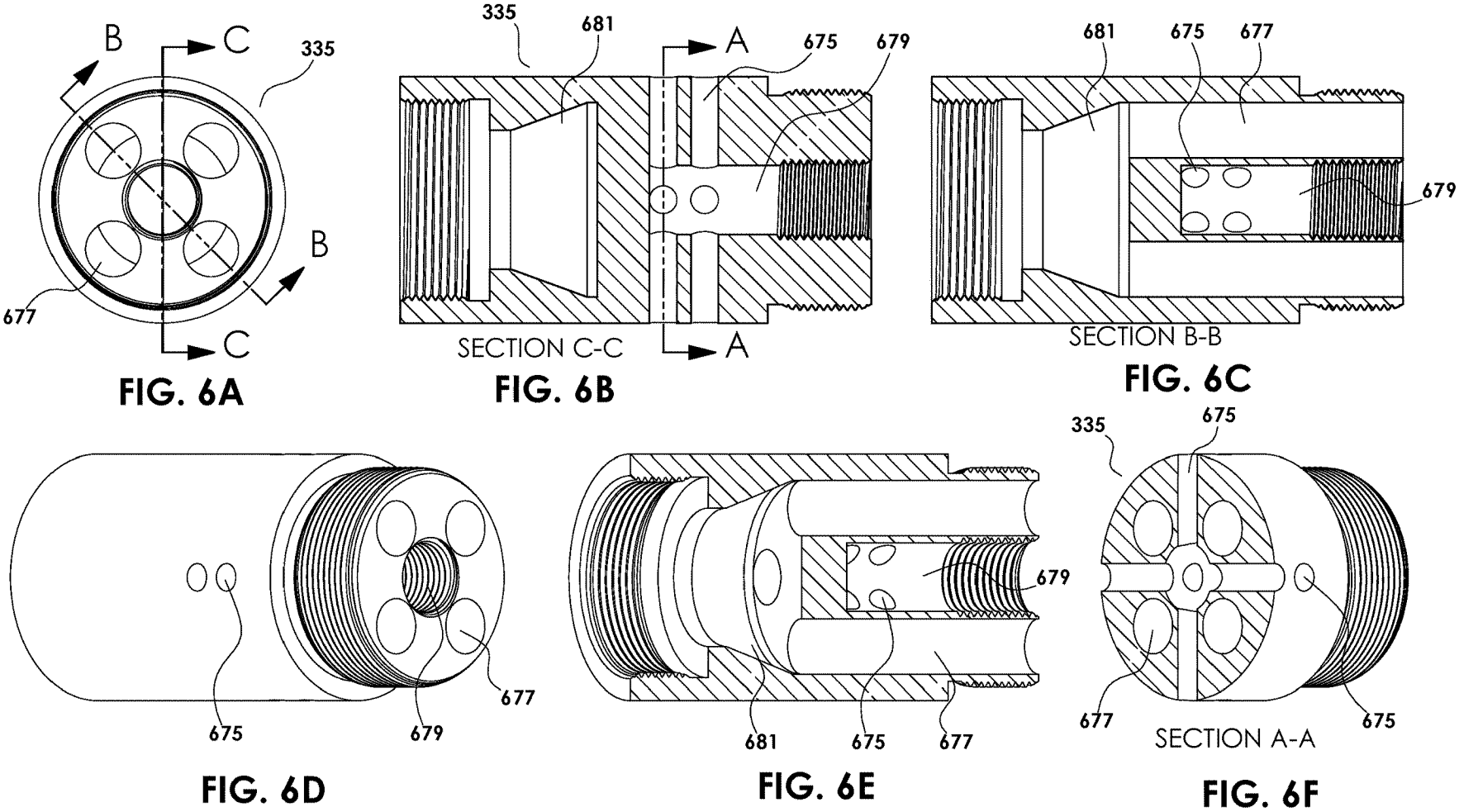
FIG. 6A illustrates a top view of a ported coupling having four longitudinal ports, according to a specific example embodiment of the disclosure.
FIG. 6B illustrates a longitudinal cross-sectional view (cross section B of FIG. 6A) of the ported coupling of FIG. 6A showing venting ports for slippage flow and a central intake port, according to a specific example embodiment of the disclosure.
FIG. 6C illustrates a cross-sectional view (cross section C of FIG. 6A) of the ported coupling of FIGS. 6A-6B showing longitudinal ports for production flow, venting ports for slippage flow, and connectivity between a central intake port and the venting ports, according to a specific example embodiment of the disclosure.
FIG. 6D illustrates a bottom perspective view of the ported coupling of FIGS. 6A-6C with longitudinal ports that diverge from a central port along with the side exit for two venting ports, according to a specific example embodiment of the disclosure.
FIG. 6E illustrates a cross-sectional view (cross section C) of the ported coupling of FIGS. 6A-6D displaying the diversion of longitudinal ports and venting ports, according to a specific example embodiment of the disclosure.
FIG. 6F illustrates a top perspective cross-sectional view of the ported coupling of FIGS. 6A-6E, cut through the illustrated venting ports (cross section D), according to a specific example embodiment of the disclosure.

FIGS. 6A and 6B illustrate cross-sectional views of ported couplings 335. As shown in FIG. 6B, ported couplings 335 have central intake ports 679 that receive fluids from plungers containing sand snares 345. Disclosed intake ports 679 connect to radial venting ports 675. Fluid received by the central intake port 679 can exit outwardly from the ported coupling 335 through the radial venting ports 675. Disclosed ported couplings 335 can have any number of radial venting ports 675. For example, ported couplings 335 can have from 1-10 radial venting ports 675. Ported couplings 335 can have 2 radial venting ports 675, or 4 radial venting ports 675, or 6 radial venting ports 675, or 8 radial venting ports 675, or 10 radial venting ports 675. Described radial venting ports 675 can have any length from 0.1 inches to about 2 inches, or even greater than about 2 inches. Disclosed venting ports 675 can have a length of about 0.1 inches, or of about 0.5 inches, or of about 1 inch, or of about 1.5 inches, or of about 2 inches. Radial venting ports 675 disclosed in this application can have any diameter ranging from 0.1 to about ¾ inches, or even greater than about ¾ inches. Radial venting ports 675 can have a diameter of about 0.1 inches, or of about 0.5 inches, or of about 0.75 inches, of about 1 inch. As shown in FIG. 6B, ported couplings have at least one central intake port 679. Disclosed central intake port 679 provides a pathway for fluid communication to-or-from a plunger containing a sand snare 345. Central intake ports 679 can have a length from 0.5 inches to about 3 inches, or even greater than about 3 inches. Central intake ports 679 can have a length of about 0.5 inches or of about 1 inch, or of about 1.5 inches, or of about 2 inches, or of about 2.5 inches, or of about 3 inches. Disclosed central intake ports 679 can have a diameter from about 0.25 inch to about 1 inches, or even greater than about 1 inches. For example, disclosed central intake ports 679 can have a diameter of about 0.25 inches, or of about 0.5 inches, or of about 0.75 inches, or of about 1 inch. Central intake ports 679 and radial venting ports 675 provide the slippage flow and the longitudinal ports 677 provide the production flow.

FIG. 6C illustrates a cross-sectional view of ported couplings disclosed in this application. As shown in FIG. 6C, longitudinal ports 677 connect to a central longitudinal port 681. Through longitudinal ports 677 and central longitudinal ports 681, ported couplings 335 can provide a path for production fluid flow 485 from a plunger containing a sand snare 345 to another plunger. For example, production fluid can be received from a plunger through longitudinal ports 677, be transported to the central longitudinal port 681 through the longitudinal ports 677, and then transferred to another plunger from the central longitudinal port 681. Disclosed central longitudinal port 681 converges fluid paths from multiple longitudinal ports 677. Additionally, ported couplings 335 can have multiple central longitudinal ports 681. Central longitudinal port 681 disclosed in this application can have a diameter from about 0.25 inches to about 1 inches, or even greater than about 1 inches. For example, central longitudinal port 681 can have a diameter of about 0.25 inches, or of about 0.5 inches, or of about 0.75 inches, or of about 1 inch. Described central longitudinal port 681 can have a length from about 1 inch to about 4 inches, or even greater than about 4 inches. For example, disclosed central longitudinal port 681 can have a length of about 1 inch or of about 1.5 inches, or of about 2 inches, or of about 2.5 inches, or of about 3 inches, or of about 3.5 inches, or of about 4 inches.

FIG. 6D illustrates a perspective view of ported couplings of disclosed sucker-rod pumping systems showing central intake port 679, longitudinal ports 677, and radial venting ports 675. FIG. 6E illustrates a cross-sectional view of ported couplings 335 showing central intake port 679 and longitudinal ports 677. FIG. 6F illustrates a top perspective cross-sectional view of ported couplings 335, with the cross-sectional cut made half way through radial venting ports 675, which shows how central intake port 679 connects to radial venting ports 675. FIG. 6F also illustrates how longitudinal ports 677 can diverge from the radial venting ports 675. Ported couplings 335 can be machined as a single piece, or as an assembly of two-or-more pieces that may maintain the same fit, form, and function of the ported coupling 335 as specified above.

Disclosed central intake ports 679, longitudinal ports 677, and radial venting ports 675 can have generally cylindrical shapes with circular cross-sections, but can also have non-circular cross-sections. For example, cross-sectional shapes include any ellipses and any polygons. It also should be appreciated that the designation of a port as being "radial" or "longitudinal" or "central" is for illustrative purposes and other dimensional configurations can be used to accomplish similar flow patterns.

Figure 7A:
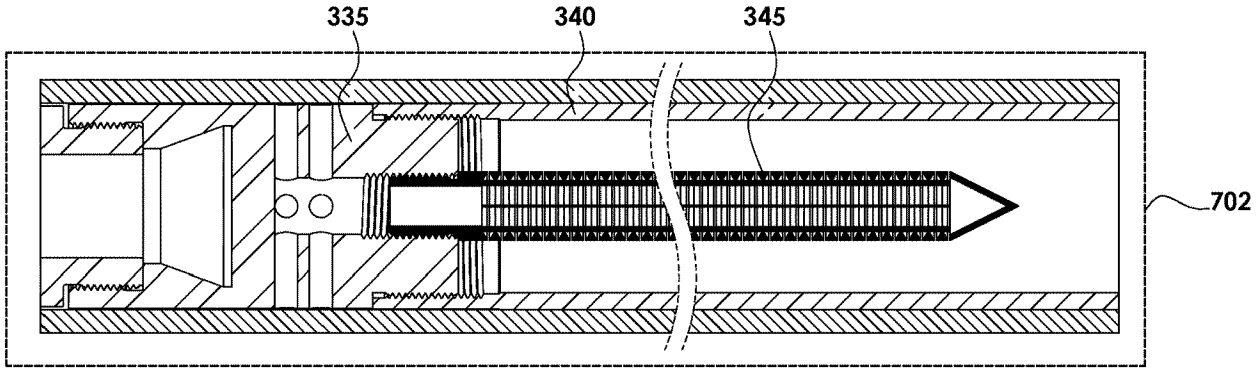
FIG. 7A illustrates a cross-sectional view of a ported coupling connecting with a plunger containing a fine barrier element or sand snare of a sucker-rod pumping system according to a specific example embodiment of the disclosure.

FIG. 7A illustrates a cross-sectional view of a fine sand snare 345 connected to a ported coupling 335 in accordance with a sucker-rod pumping system disclosed in this application. As shown in FIG. 7A, ported couplings 335 connect to box-end plungers 340, which contain sand snares 345. Additionally, couplings 335 can also connect to wiper plungers, which can also contain sand snares.

Figure 7B:
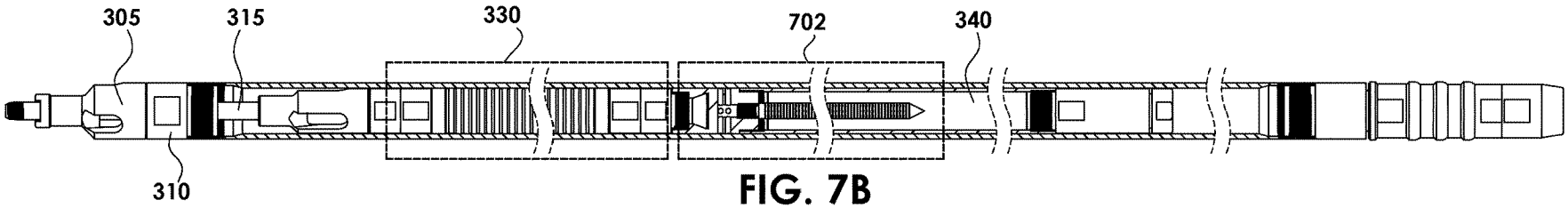
FIG. 7B illustrates a perspective view of the ported coupling of FIG. 7A connecting the wiper plunger to the box-end plunger according to a specific example embodiment of the disclosure.

FIG. 7B illustrates a perspective view of a coupling/fine sand snare section 702 of a sucker-rod pumping system according to a specific example embodiment of the disclosure. As shown in FIG. 7B, valve rods 315 connect to wiper plungers 330, which can further connect to a box-end plunger 340. Alternatively, valve rods 315 can connect to box-end plungers 340, which can further connect to wiper plungers 330.

Figure 7C:
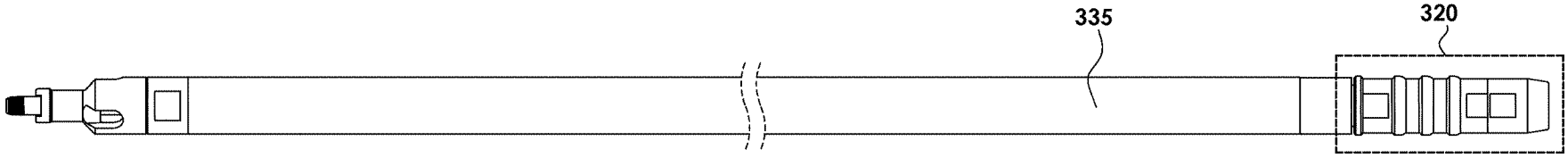
FIG. 7C illustrates a perspective view of a guide attaching to a hold-down through a barrel of a sucker-rod pumping system according to a specific example embodiment of the disclosure.

FIG. 7C illustrates a perspective view of a guide attaching to a hold-down through a barrel of a sucker-rod pumping system as disclosed in this application. As shown in FIG. 7C, a guide 305 is connected to a hold-down 320 through a barrel 355 containing the wiper plunger 330, a box-end plunger 340, and sand snare 345 shown in FIG. 7B.

Also, hold-downs 320 can be positioned on both the upper or lower end of a barrel 355. Described ported couplings as shown in FIG. 6 are mechanically loaded into the sucker-rod pumping system. Mechanically loading ported couplings permit couplings to withstand high loads associated with rod pumping. Additionally, mechanically loaded ported couplings can withstand the weight of the sucker-rod pumping system components located below the coupling, and the hydrostatic column of production fluid above the pump.

Figure 8:
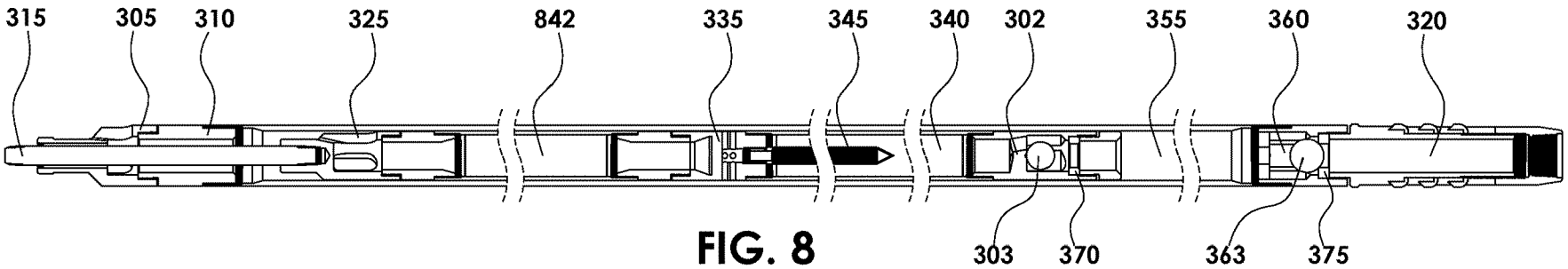
FIG. 8 illustrates a longitudinal cross-sectional view of an sucker-rod pumping system having two box-end plungers during an upstroke part of the pumping cycle, according to a specific example embodiment of the disclosure.

FIG. 8 illustrates a sucker-rod pumping system with two box-end plungers 340, 842. One or both of the box-end plungers contain a sand snare 345, being in fluid communication with traveling valve 302, and can both receive wellbore fluids and separate sand from the wellbore fluid to make a substantially sand-free slippage fluid. Box-end plunger 842 can be fluidically connected to box-end plunger 340 through ported coupling 335. Systems having two box-end plungers 340, 842 containing sand snares may desirably provide additional "Sand Trap Surface Area" or "STSA."

As shown in FIG. 8, the sucker-rod pumping system includes a guide 305, a connector 310, a valve rod 315, and a hold-down 320. Disclosed guides 305 help prevent valve rod 315 misalignment-based mechanical friction that would be caused by their bending. Guides 305 can be made of metal or polymers. As shown in FIG. 8, sucker-rod pumping systems contain top bushings 325 which connect the plunger to the valve rod, and function as the outlet port for the plunger, driving the production fluid flowing upward inside the plunger into the annular space formed by the valve rod and the barrel 355. Disclosed barrels 355 can connect to standing valves 360 and traveling valves 302.

Although the above description of FIGS. 4A through 8 include specific implementation details, one of ordinary skill in the art would understand that the features of these descriptions can be implemented and should be considered a part of the embodiments of FIG. 3 where helpful or efficacious in the design of such embodiments. It should further be appreciated that the features of all of the embodiments of FIG. 3-8 should not be limited to any single of those embodiments, and in fact may be applicable, according to design needs or advantages, to the below embodiments of FIGS. 9-16.

Distributed Balancing Chamber Embodiments:

Additional embodiments are described below as "distributed balancing chamber embodiments." It should be understood that the descriptions of the embodiments of FIGS. 3-8 are applicable to the implementations of these distributed balancing chamber embodiments. It should be further understood that the general descriptions of the distributed balancing chamber embodiments are applicable, according to design needs or advantages, to the implementations of FIGS. 3-8.

Figure 9A:
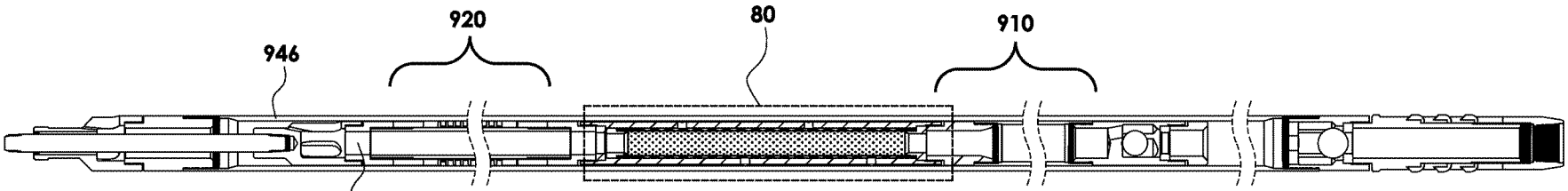
FIG. 9A is a longitudinal cross-sectional view of an embodiment of the present disclosure having a distributed sand snare.
Figure 9B:
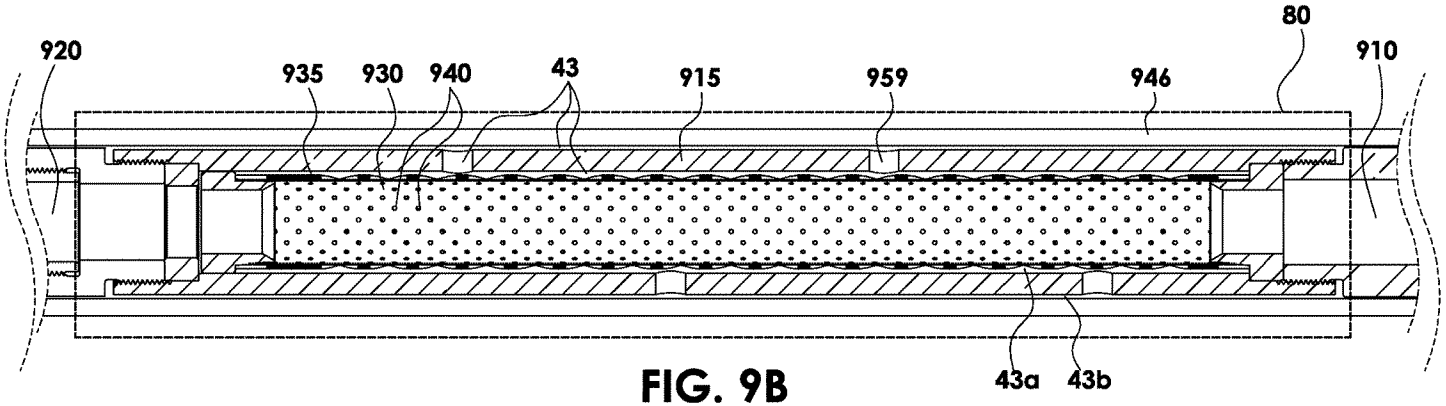
FIG. 9B is a closer view of FIG. 9A.

FIG. 9A-9B provides a longitudinal cross-sectional views of a portion of a sucker rod string, particularly illustrating a plunger 902 within a barrel 946. Specifically, the illustrated portion of the sucker rod string focuses on a plunger 902 comprising a lower plunger 910 and an upper plunger 920 with a pull tube 915 connecting the upper and lower plungers 910, 920. Within the pull tube 915 is a balancing chamber subsection 80 of the present embodiment in which a sand snare 70 (see FIG. 9B, for a more detailed view and labels for the referenced elements not shown in FIG. 9A) is provided. In this embodiment, a central meshed or permeable tube 930 passes the production fluid. FIG. 9B illustrates the permeability of the permeable tube 930 with illustrated perforations 940, although in embodiments these may be small apertures 940 or the tube 930 may be a fine mesh with a weave that will allow a portion of the production fluid 59 to pass outwardly to become the slippage flow fluid within the distributed pressure balancing chamber 43 of the present embodiment.

In the disclosed embodiments, the perforated tube 930 may be further surrounded by a support tube 935 or exoskeleton that provides additional structural support. Note that with this disclosed structure, the distributed pressure balancing chamber 43 is balanced both longitudinally (along the length of the pull tube 915) and circumferentially, with there being an inner circumference pressure balancing subchamber 43*a* and an outer circumference pressure balancing subchamber 43*b* (with there being fluid communication between both the inner subchamber 43*a* and outer subchamber 43*b*) through the ports 959 that pass through the walls of the pull tube 915.

Figure 10A:
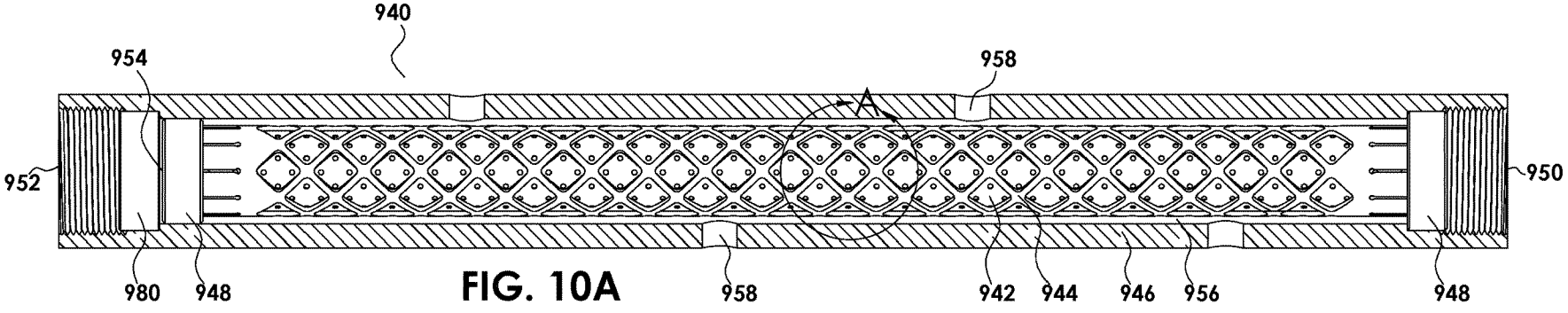
FIG. 10A is an illustration of a distributed sand snare, according to some embodiments of the present disclosure.

FIG. 10A illustrates one embodiment of the current disclosure. The embodiment of FIG. 10A may comprise a thin filter sand separator 940 with a fine mesh filter component 942 with perforations, shaped so that it forms a hollow tube through which material, e.g. crude oil, may flow. The hollow tube may comprise the central cavity 954 of the thin filter sand separator 940. The fine mesh filter component 942 may be supported by an exoskeleton 944. As shown in FIG. 10A, the fine mesh filter component 942 and its supporting exoskeleton 944 may be concentrically arranged within a pull tube 946 and secured in place by one or more caps 948, each with a central bore. When each cap 948 is secured in place, the central bore of each cap 948 may line up with the central cavity 954 of the filter in a manner such that a material, e.g. crude oil, is allowed to flow from a first end 950 of the filter to a second end 952 of the filter. Further included at the second end 952 of the filter is a seating element 980 that facilitates the securing of the exoskeleton 944 and fine mesh filter component 942 within the filter.

According to some embodiments, the flow of material may comprise a production flow. As the material in the production flow travels through the central cavity 954, it comes in contact with the inner surface of the fine mesh filter component 942 and a volume of the material is allowed to pass from the central cavity 954, through the fine mesh filter component 942, and into a reservoir 956 (e.g. the space between the exoskeleton 944 and the pull tube 946). The volume of material may pass through the fine mesh filter component 942 at a rate determined by the pump design and operation parameters such as the plunger fit and length, the pump setting depth, the pumping speed (SPM) and the stroke length, among many other parameters. According to the disclosed embodiments, the sand trap 70, and in certain embodiments its included fine mesh filter component 942, allows for and does not significantly diminish or impair the slippage flow rate. Passage through the fine mesh filter component 942 may filter particulate matter from the material, e.g. crude oil, as it passes through. The size range of the particles allowed to pass from the central cavity 954 to the reservoir 956 may be regulated by the diameter of the perforations in the fine mesh filter component 942, discussed in detail below. Material that has passed through the fine mesh filter component 942 and into the reservoir 956 may be completely, or substantially, sand-free material referred to as slippage fluid. Slippage fluid may pass from the reservoir 956 to the exterior of the thin filter sand separator 940 through one or more venting ports 958 in the pull tube 946, where it may be redirected and/or used for any number of purposes, including the lubrication of a fluid seal on an oil pump.

Figure 10C:
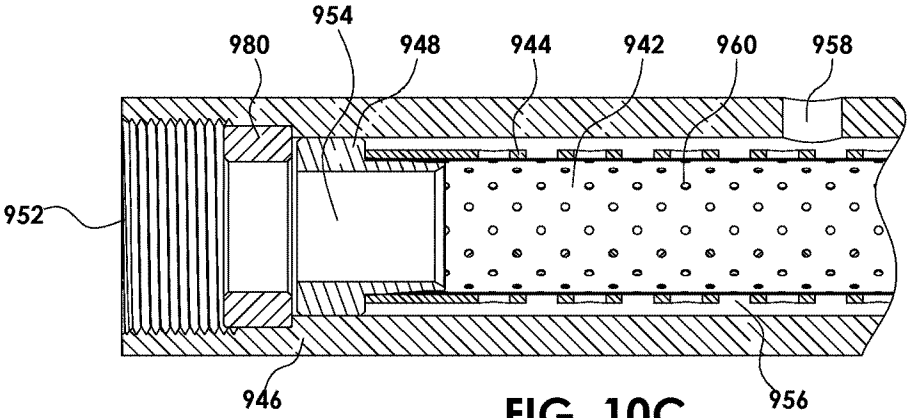
FIG. 10C is an illustration of an up-close view of the distributed pressure chamber sand snare of FIG. 10A, according to some embodiments of the present disclosure.
Figure 10B:
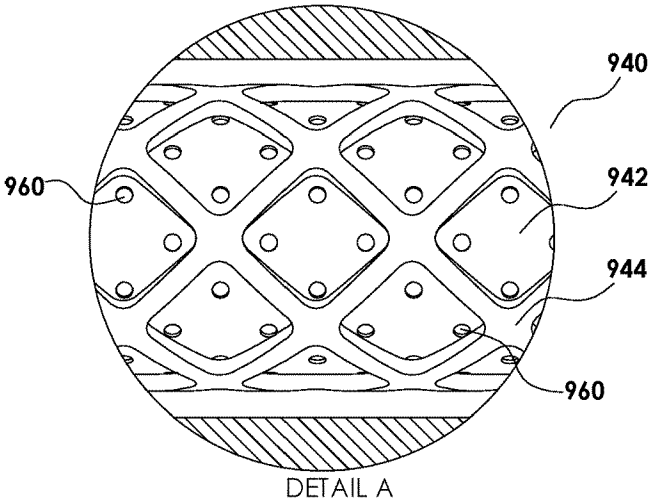
FIG. 10B is an illustration of an up-close view of a fine mesh filter and exoskeleton comprising a sand snare, according to some embodiments of the present disclosure.

FIG. 10B is an illustration of a close-up view of an embodiment of a thin filter sand separator 940 of the current disclosure. As shown, the fine mesh filter component 942 is concentrically arranged inside of an exoskeleton 944. As shown, the fine mesh filter component 942 is an ultrathin sheet of metal with numerous perforations 960, which allow for the passage of materials, e.g. crude oil, from the interior of the thin filter sand separator 940 to the reservoir. A fine mesh filter component 942 may be comprised of any one or combination of metals and alloys, including, but not limited to, nickel, steel, copper, etc.

In some embodiments, the fine mesh filter component 942 may be further coated with another substance, e.g., chrome, to improve its strength, resilience, porosity, and/or anticorrosive or other properties. The perforations 960 may be spaced across the fine mesh filter component 942 in a manner such that it has a screen-like texture suitable for filtering particulate matter from materials, e.g. crude oil. As shown in FIG. 10B, the perforations 960 are uniformly distributed across fine mesh filter component 942. The filtering resolution of the fine mesh filter component 942, e.g. the size of particulate matter it may prevent from passing through, may be adjusted according to need. In this way, filtering rocks from a material would require lower resolution (and larger perforations) than would filtering sand from the same material (requiring smaller perforations). Where sand is a particulate of interest, perforation 960 diameters may range from about 0.001 inches to about 0.020 inches.

The fine mesh filter component 942 may comprise a non-profiled filter with a smooth interior surface. While there are several advantages to this configuration, a notable advantage of the current disclosure is that it provides for a larger interior area through which a material, e.g. crude oil, may flow. Further, the smooth nature of the interior surface prevents buildup of particulate matter, e.g. sand, during the filtering process. Where the interior is not smooth, for example in profiled filter systems, particulate matter may become deposited in places along the interior of the filter, eventually leading to clogs and other mechanical issues. Here, particulate matter that is prevented from passing through the perforations 960 of the fine mesh filter component 942 are removed by materials, e.g. crude oil, in the production flow and are not allowed to deposit on the interior of the thin filter sand separator 940.

Also illustrated in FIG. 10B, an exoskeleton 944 may provide structural support for fine mesh filter component 942. According to some embodiments, a fine mesh filter component 942 may be an ultrathin sheet of metal with multiple perforations 960. An exoskeleton 944 may provide additional, structural support to the fine mesh filter component 942, which may allow it to retain its shape and to withstand elements such as high pressure and high flow rates of materials, e.g. crude oil.

Shown in FIG. 10B, the exoskeleton 944 may comprise a metal scaffold-like structure which is concentrically arranged around the exterior of the fine mesh filter component 942. The exoskeleton 944 may comprise any shape or pattern that may be created in order to balance (1) support for the fine mesh filter component 942, and (2) the outflow of slippage fluid into the reservoir. In FIG. 10B, the exoskeleton is shown with a crisscross shape, providing structural support for the ultrathin, fine filter mesh component 942 and providing large, diamond shaped openings that expose the exterior surface of the fine filter mesh component 942 to the reservoir. It should be appreciated that this particular arrangement is for illustrative purposes only and that multiple arrangements and/or patterns may be used for an exoskeleton 944. An exoskeleton 944 may be comprised of any one or combination of metals, alloys, resins, plastics, polymers, or the like. The composition of an exoskeleton 944 may be customized to address any number of external or internal factors, including temperature, pressure, material flow rates, and/or elemental exposure.

FIG. 10C illustrates in greater detail the elements of the second end 952 of the filter, including a more detailed view of how the seating element 980 helps secure the exoskeleton 944 and fine mesh filter component 942 within the filter.

Figure 11C:
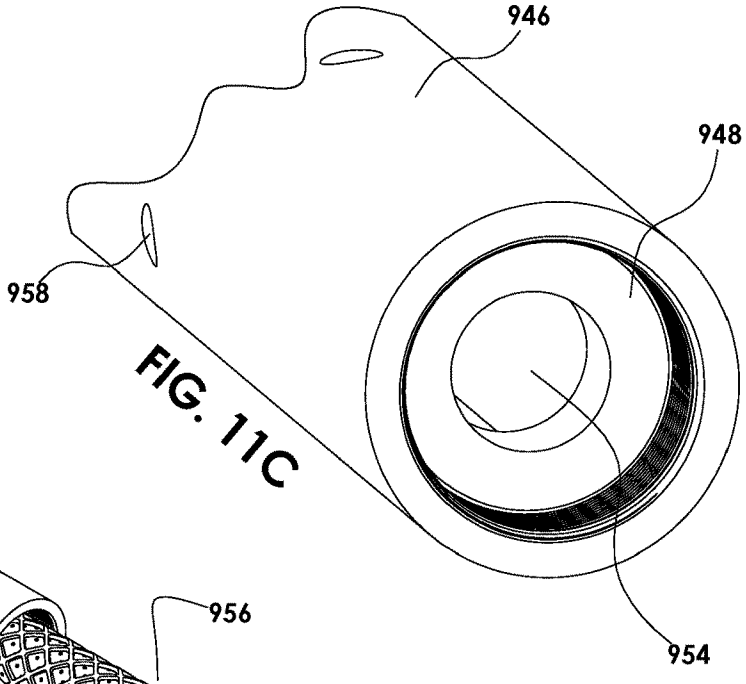
FIG. 11C is an illustration of a pull tube, exoskeleton, and fine mesh filter in a closed configuration, according to some embodiments of the present disclosure.
Figure 11B:
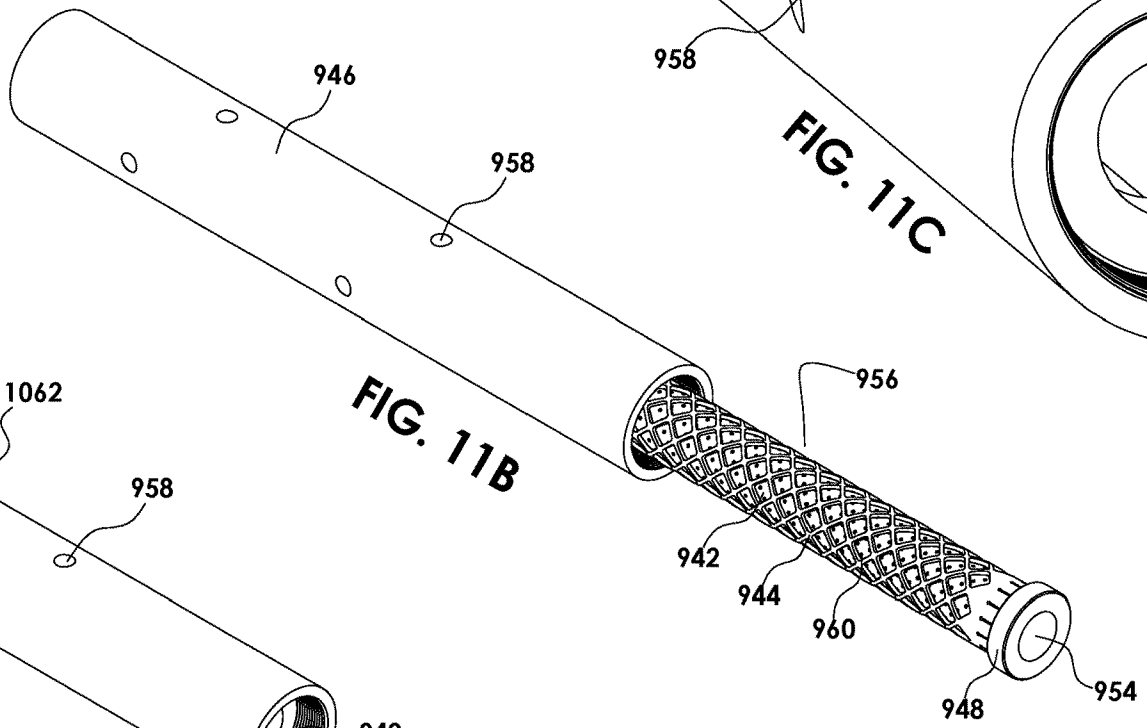
FIG. 11B is an illustration of a pull tube, exoskeleton, and fine mesh sand snare filter in an open configuration, according to some embodiments of the present disclosure.
Figure 11A:
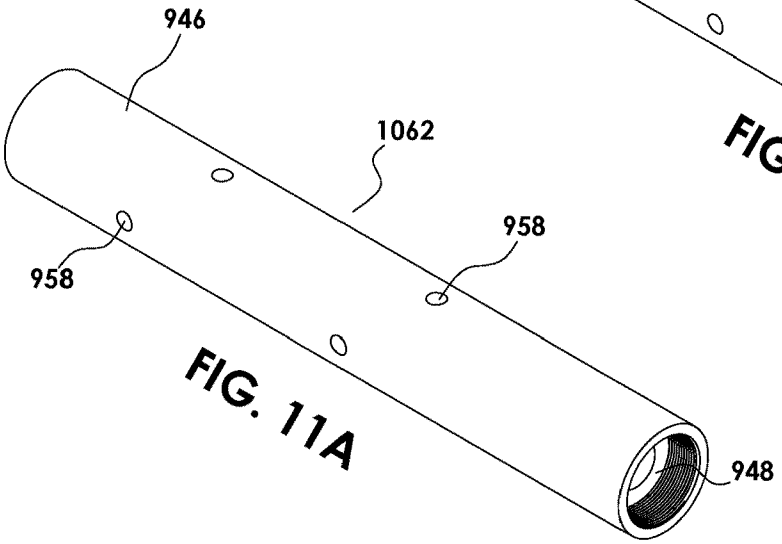
FIG. 11A is an illustration of a pull tube, according to some embodiments of the present disclosure.

Shown in FIGS. 11A-C, a pull tube 946 (as also shown in FIG. 10A) may be concentrically arranged exterior to both the fine mesh filter 942 and exoskeleton 944, and in a manner such that, when fully assembled, its positioning creates a reservoir 956 between the exoskeleton 944 and the pull tube 946. According to some embodiments, slippage fluid, e.g. material that has been passed through the fine mesh filter 942, may be housed in the reservoir 956 before being moved to the exterior of the thin filter sand separator 940.

Shown in FIG. 11A, a pull tube 946 may comprise a tube that is configured to be concentrically arranged exterior to a fine mesh filter and exoskeleton. The pull tube 946 may be comprised of one or a combination of metals, alloys, resins, plastics, polymers, or the like, and the composition of a pull tube 946 may be customized to address any number of external or internal factors, including temperature, pressure, material flow rates, and/or elemental exposure. A pull tube 946 may further comprise one or more venting ports 958, extending from the interior surface of the pull tube 946 to the exterior surface of the pull tube 946 and arranged in a manner such that, when the filter assembly is in the proper configuration, they provide an opening which may allow slippage fluid to move from the reservoir to the exterior 1062 of the thin filter sand separator. The number, positioning, and diameter of venting ports 958 may vary, depending on the specific needs of a user. For example, where a higher throughput is desired, an increase in the number and/or diameter of venting ports 958 may be increased.

Illustrated in FIGS. 10B-C is an assembled fine mesh filter 942 and exoskeleton 944, shown partially inside the pull tube 946 (FIG. 10B) and in its assembled configuration, e.g. completely inside the interior of the pull tube 946 (FIG. 11C), such that only the cap 948 is visible from the exterior 1062. As illustrated in FIG. 10B, the diameter of the exoskeleton 944 may be smaller than the diameter pull tube 946.

Figure 12:
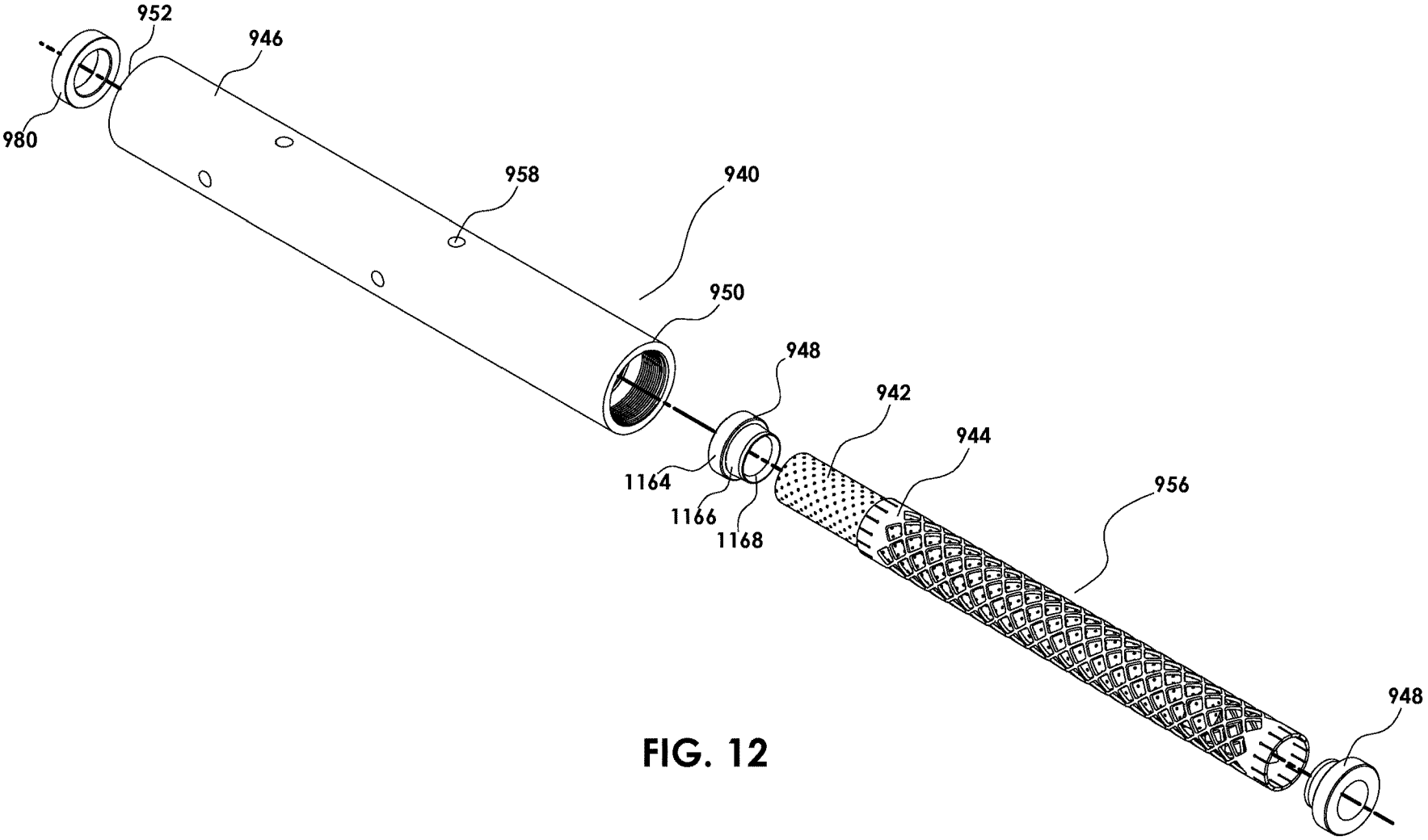
FIGS. 12 and 12A are illustrations of a thin filter sand snare, according to some embodiments of the present disclosure.
Figure 12A:
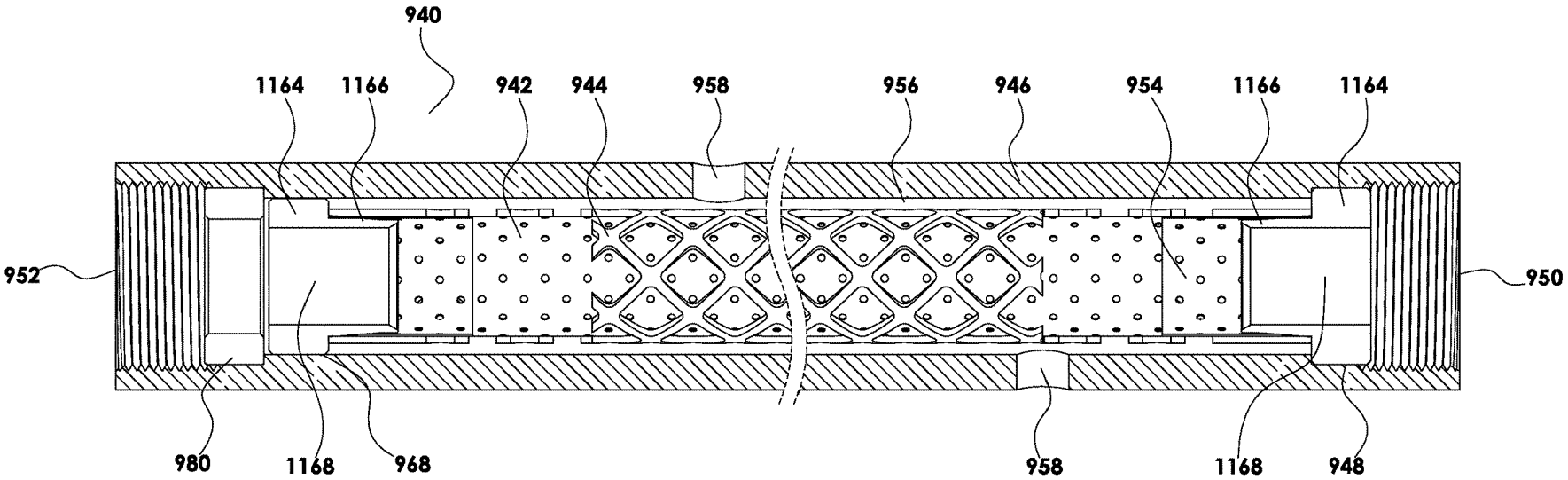

FIGS. 12 and 12A illustrate an embodiment of an assembled thin filter sand separator 940. According to some embodiments, a thin filter sand separator 940 may comprise one or more caps 948. As shown in FIGS. 12 and 12A, a cap 948 may be positioned at each end, e.g. first end 950 and second end 952, and configured to secure different components of the thin filter sand separator 940 together in a stable manner. A cap 948*d* may have a head 1164, a centralized prong 1166, and a central bore 1168. According to some embodiments, a centralized prong 1166 may have a diameter that is smaller than the diameter of the head 1164. The centralized prong 1166 in FIG. 12A is configured to fit securely and concentrically inside the exoskeleton 944 and be in contact with the fine mesh filter 942 in a manner such that contact between the centralized prong 1166, the fine mesh filter 942, and the interior surface of the exoskeleton 944 secures the fine mesh filter 942 in place and prevents movement of the fine mesh filter 942 with respect to the exoskeleton 944.

Also shown in FIG. 12A, the head 1164 of the cap 948 has a diameter greater than the diameter of the centralized prong 1166, but smaller than the pull tube 946, and is configured to secure the exoskeleton 944 in place and prevent movement of the exoskeleton 944 with respect to the pull tube 946. Further, the head 1164 of the cap 948 may be sized such that contact between the head 1164 and the interior surface of the pull tube 946 creates a seal through which material, e.g. slippage fluid, may not escape the reservoir 956. In this manner, slippage fluid may be directed to the exterior of the thin filter sand separator 940 and to the desired components in the larger system, e.g. oil pump. The central bore 1168 may extend through the length of the cap 948, through both the head 1164 and the centralized prong 1166, and in a manner such that, when properly configured, it provides a continuous opening, from the first end 950 to the second end 952, and comprising each central bore 1168, and the central cavity created by the fine mesh filter 942.

A thin filter sand separator 940 may provide many advantages over other approaches to other downhole filters, including an increased area for production flow, a decrease in clogging incidences, and a less-contaminated slippage fluid for use in the system. A thin filter sand separator 940, according to some embodiments, may allow for the passage of a production flow of material, e.g. crude oil, from a first end 950 of the thin filter sand separator 940 to a second end of the thin filter sand separator 940. As it passes through the thin filter sand separator 940, the material in the production flow may contact a fine mesh filter 942, secured and stabilized by an exoskeleton 944 and one or more caps 948. The fine mesh filter 942 may comprise perforations, allowing some material, e.g. slippage fluid, to pass from the central cavity of the thin filter sand separator 940 and into the reservoir 956 between the exoskeleton 944 and the pull tube 946.

Some particulates, e.g. sand, etc., are size prohibited from passing through the fine mesh filter 942 and remain in the material in the production flow. Further, the movement of the production flow, coupled with the smooth nature of the fine mesh filter 942, prevent the particulates from accumulating and causing problems such as clogging. The slippage fluid in the reservoir 956 is prevented from exiting at the ends (first end 952, second end 954) by the caps 948, and is instead redirected through one or more venting ports 958 in the pull tube 946. The venting ports 958 allow the slippage fluid to be directed to the exterior 1062 of the thin filter sand separator 940, where it may be used in other parts of the system.

Figure 13:
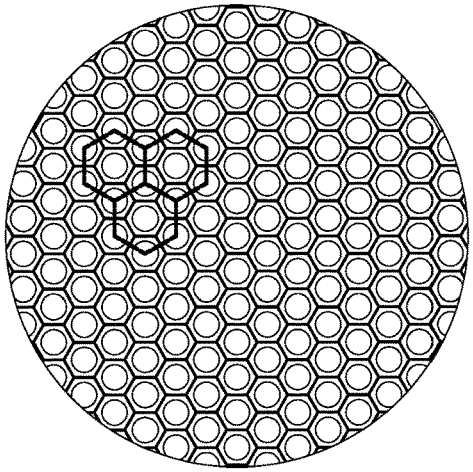
FIG. 13 is an illustration of an exemplary fine mesh sand snare patterning according to some embodiments of the present disclosure.

FIG. 13 illustrates in greater focus one possible mesh pattern for the thin mesh filter component 942. Illustrated in the figure is a pattern 1302, and in this illustrated embodiment it may be described as a hexagonal or honeycomb pattern, which may be used in exemplary embodiments. The mesh filter component may be manufactured by chemical etching, laser cutting, electro-discharge machining, water jetting, electroforming, plasma cutting, photolithography methods, or 3D printing. Further, woven meshes of different patterns such as plain, twill, Dutch, reverse "off-count", standard weave, etc. may as well be used. The mesh may have different regular geometric patterns or an irregular array of perforations/fibers. For example, the mesh could use a regular hexagonal array as illustrated in the present figuration with a perforation on each one of the vertices of the pattern and centered in the pattern as shown.

Figure 14:
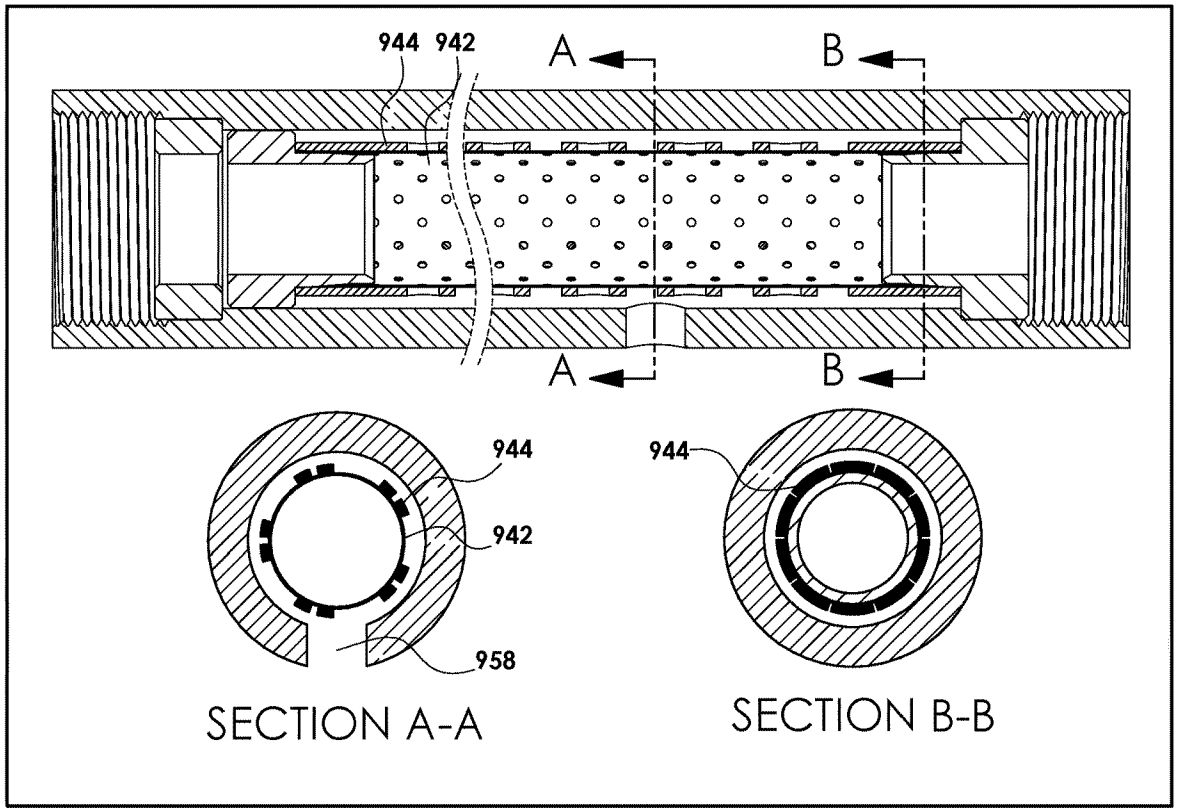
FIG. 14 is an illustration describing the improved fluid flow characteristics of disclosed embodiments of the present disclosure.

FIG. 14 illustrates and describes a fluid flow performance advantage as enabled by the presently described embodiments in that the efficient concentric pattern between the exoskeleton 944 and the thin mesh layer component 942 allows an improved area for fluid flow for a comparable tube diameter/circumference. The efficient exoskeleton 944/thin mesh layer 942 mating creates a greater opening, which when coupled with the avoidance of the need for exposed weld matings provides a flow area of greater than 1.2× or 1.5× or 2.0× that of known sand filters having the comparable tube diameters/circumferences. Specifically, the "A" slice shows a slice view through the middle of the distributed pressure subsystem and it shows the large area for fluid flow available in this approach along with providing a sectional opening view of one of the venting ports 958 through the rigid support or exoskeleton 935. The "B" slice shows a cross sectional view toward the end of the assembly and it illustrates a clean inner diameter with no exposed weld mates.

The present disclosure relates to downhole pump systems including multiple plungers connected by ported couplings, with at least one of the plungers containing a barrier element or sand snare that separates or filters sand from the slippage fluid. In general, any two plungers may be connected through a single ported coupling, in embodiments where ported couplings are used, and disclosed embodiments generally include a string of multiple plungers connected by multiple ported couplings (again, in embodiments where ported couplings are used). The combined ported coupling and plungers with at least one sand snare as further described below provides for synergistic component life extension by a) reducing sand caused wear and b) providing sand-free slippage flow for simultaneously lubricating components. Disclosed ported couplings and barrier elements separate the wellbore fluids into a) sand-laden production fluid that is taken to an above-ground collection, and b) substantially sand-free slippage flow that is diverted to function as a lubricant for downhole pump system components. Reducing sand in the slippage fluid helps extend the life of downhole pump systems by reducing the above-described wear that leads to diminished performance or system efficiencies or system failure.

Further, with regard to the distributed balancing chamber embodiments, there is a synergy in providing a sand snare within an inner circumference through which the production fluid passes along with an outer rigid tube or exoskeleton, as such outer rigid tube or exoskeleton provides mechanical support but also provides a distributed pressure balancing chamber that is both longitudinally and circumferentially distributed. The effective distribution of the pressure balancing chamber provides for smaller pressure gradients and lesser pressure buildup across components, and accordingly provides for less-stressed and longer-life components relative to prior art approaches.

Where the verb "may" appears, it is intended to convey an optional and/or permissive condition, but its use is not intended to suggest any lack of operability unless otherwise indicated. Where open terms such as "having" or "comprising" are used, one of ordinary skill in the art having the benefit of the instant disclosure will appreciate that the disclosed features or steps optionally may be combined with additional features or steps. Such option may not be exercised and, indeed, in some embodiments, disclosed systems, compositions, apparatuses, and/or methods may exclude any other features or steps beyond those disclosed herein. Persons skilled in the art may make various changes in the systems of the disclosure.

Also, where ranges have been provided, the disclosed endpoints may be treated as exact and/or approximations as desired or demanded by the particular embodiment. Where the endpoints are approximate, the degree of flexibility may vary in proportion to the order of magnitude of the range. For example, on one hand, a range endpoint of about 50 in the context of a range of about 5 to about 50 may include 50.5, but not 52.5 or 55 and, on the other hand, a range endpoint of about 50 in the context of a range of about 0.5 to about 50 may include 55, but not 60 or 75. In addition, it may be desirable, in some embodiments, to mix and match range endpoints. Also, in some embodiments, each figure disclosed (e.g., in one or more of the examples, tables, and/or drawings) may form the basis of a range (e.g., depicted value +/− about 10%, depicted value +/− about 50%, depicted value +/− about 100%) and/or a range endpoint. With respect to the former, a value of 50 depicted in an example, table, and/or drawing may form the basis of a range of, for example, about 45 to about 55, about 25 to about 100, and/or about 0 to about 100. Disclosed percentages are weight percentages except where indicated otherwise.

All or a portion of a device and/or system for gear rod rotators may be configured and arranged to be disposable, serviceable, interchangeable, and/or replaceable. These equivalents and alternatives along with obvious changes and modifications are intended to be included within the scope of the present disclosure. Accordingly, the foregoing disclosure is intended to be illustrative, but not limiting, of the scope of the disclosure.

What is claimed is:

1. A plunger for use in a sucker-rod pumping system for reciprocating at least partially concentrically within a barrel in the sucker-rod pumping system, the sucker-rod pumping system further comprising seals between the plunger and the barrel, each of the seals allowing a reciprocal movement between the plunger and barrel while providing a concentric barrier against longitudinal fluid movement between an outer diameter of the plunger and the inner diameter of the barrel, wherein the sucker-rod pumping system is operable to develop pumping pressure to move a production fluid toward a wellhead in a fluid production well, the plunger comprising:

a) a first section that is operable to be sealed against the barrel by one of the seals;

b) a third section that is operable to be sealed against the barrel by one of the seals;

c) a second section that is connected between the first and the third sections, wherein the plunger assembly comprising the first, second, and third sections is operable to be sealed against the barrel on opposing sides of the second section to form a sealed plunger area, and wherein the sealed plunger area is operable to allow for the reciprocating movement of the plunger relative to the barrel while developing a fluid pumping pressure to move the production fluid toward the wellhead, wherein the first, second, and third sections of the plunger further define a through passage for the movement of the production fluid toward the wellhead, the through passage having a cross-sectional fluid passage area, wherein the plunger further comprises a pressure balancing chamber at least partially delimited within the sealed plunger area that is operable to equalize pressure on longitudinal sides of the seals, and wherein the pressure balancing chamber comprises an inner subchamber and an outer subchamber with there being fluid communication between the inner subchamber and the outer subchamber through a chamber port;

e) a sand snare comprised within the plunger and allowing for fluid communication between the through passage and the pressure balancing chamber, the sand snare having a surface area at least as great as the cross-sectional fluid passage area, the sand snare operable to restrain solids from reaching the pressure balancing chamber from the through passage, thereby producing a slippage flow to the pressure balancing chamber that is relatively free of solids, the slippage flow operable to equalize pressure between the balancing chamber and the plunger's through passage; and f) at least one port between the second section and one of the first and third sections, the at least one port forming a part of the through passage and a portion of the pressure balancing chamber, the at least one port keeping the through passage and the pressure balancing chamber fluidically separated, wherein production fluid is configured to pass through the through passage and wherein the slippage flow moves through the at least one port's portion of the pressure balancing chamber.

2. The plunger of claim 1, wherein the sand snare is at least partially in the first section.

3. The plunger of claim 1, wherein the sand snare is at least partially in the second section.

4. The plunger of claim 1, wherein the sand snare is at least partially in the third section.

5. The plunger of claim 1, wherein the sand snare is manufactured by a method from the group consisting of chemical etching, laser cutting, electrodischarge machining, water jetting, electroforming, plasma cutting, photolithography methods, 3D printing, and weaving of meshes.

6. The plunger of claim 5, wherein the sand snare is manufactured by the weaving of meshes and wherein the mesh weave is selected from the group consisting of plain, twill, Dutch, reverse off-count, and standard.

7. The plunger of claim 1, wherein the sand snare comprises a coated metal.

8. The plunger of claim 7, wherein the coating is a thermal or chemical treatment.

9. The plunger of claim 8, wherein the coating provides resistance to corrosion and/or abrasion.

10. The plunger of claim 1, wherein the sand snare comprises geometrically arranged fluid openings to allow the passage of fluid between the through passage and the pressure balancing chamber.

11. The plunger of claim 10, wherein the geometrically arranged fluid openings that are geometrically arranged in a pattern from the group consisting of triangular, quadrilateral, pentagonal, and hexagonal.

12. The plunger of claim 1, wherein the sand snare comprises slotted openings have varied aspect ratios.

13. The plunger of claim 1, wherein the sand snare comprises openings that are a regular geometric form.

14. The plunger of claim 1, wherein the sand snare comprises openings that are an irregular geometric form.

15. The plunger of claim 1, wherein the sand snare comprises a profiled wire filter.

16. The plunger of claim 15, wherein the profiled wire filter is an outside-in configuration in which it comprises a surface having narrow openings face out relative to a longitudinal axis of the plunger.

17. The plunger of claim 1, wherein at least one of the seals is resilient.

18. The plunger of claim 17, wherein the at least resilient seal is elastomeric.

19. The plunger of claim 1, wherein at least one of the seals is fluidic.

* * * * *